US012680780B2

(12) United States Patent
Snider et al.

(10) Patent No.: US 12,680,780 B2
(45) Date of Patent: Jul. 14, 2026

(54) NON-LETHAL GAS OPERATED GUN

(71) Applicant: Unit Solutions, Inc., Culver City, CA (US)

(72) Inventors: Sol Cody Snider, New York, NY (US); Jamie Scott Snider, Culver City, CA (US); Zachary Christopher Lloyd, Akron, OH (US); Robert Brian Lane, Oceanside, CA (US); Kevin Lee Bokelman, Vista, CA (US); Nathan Thomas Balcom, Vista, CA (US); Mark Jonathon Gordon, Vista, CA (US); Antonio S. Murcia, Vista, CA (US)

(73) Assignee: Unit Solutions, Inc., Thompsons Station (TN)

( * ) Notice: Subject to any disclaimer, the term of this patent is extended or adjusted under 35 U.S.C. 154(b) by 170 days.

(21) Appl. No.: 18/574,938

(22) PCT Filed: Jun. 29, 2022

(86) PCT No.: PCT/US2022/035532
§ 371 (c)(1),
(2) Date: Jun. 6, 2024

(87) PCT Pub. No.: WO2023/278584
PCT Pub. Date: Jan. 5, 2023

(65) Prior Publication Data

US 2024/0369320 A1 Nov. 7, 2024

Related U.S. Application Data

(60) Provisional application No. 63/218,262, filed on Jul. 2, 2021.

(51) Int. Cl.
*F41B 11/56* (2013.01)
*F41B 11/62* (2013.01)
*F41B 11/51* (2013.01)

(52) U.S. Cl.
CPC ..... *F41B 11/56* (2013.01); *F41B 11/62* (2013.01); *F41B 11/51* (2013.01)

(58) Field of Classification Search
CPC ..... F41B 11/50; F41B 11/51; F41B 11/53; F41B 11/52; F41B 11/54; F41B 11/55;
(Continued)

(56) References Cited

U.S. PATENT DOCUMENTS

2012/0122058 A1* 5/2012 Jensen ..... F41A 9/62 434/16
2013/0192574 A1* 8/2013 Maeda ..... F41B 11/62 124/56
2018/0058800 A1* 3/2018 Sandgren ..... F41A 9/69

FOREIGN PATENT DOCUMENTS

CA 3035535 A1 * 3/2018 ..... F41B 11/54
JP 2003075096 A * 3/2003 ..... F41B 11/56
WO WO 2003/106912 A2 12/2003

OTHER PUBLICATIONS

International Search Report and Written Opinion received in related PCT/US2022/035532 dated Nov. 15, 2022 (pp. 13).

* cited by examiner

*Primary Examiner* — John Cooper
(74) *Attorney, Agent, or Firm* — Woodard, Emhardt, Henry, Reeves & Wagner, LLP

(57) ABSTRACT

A latching magazine including a latch member and a safety closure that engages the latch member and blocks movement of the latch member. An air gun including a barrel block with a cruciform shaped projectile hopper that includes a top recess that is narrower than a projectile diameter and a top
(Continued)

recess and a bottom recess that is wider than the projectile diameter. An assembly for use with an air gun that includes a housing that contains a plurality of double-stacked projectiles, a storage portion that is wider than at least one and a half projectile diameters, a follower with a first surface and a head that includes a second surface that is orientated at an obtuse angle relative to the first surface with both surfaces engaging projectiles in the storage portion.

14 Claims, 30 Drawing Sheets

(58) Field of Classification Search
CPC ..... F41B 11/56; F41B 11/57; F41B 11/62; F41B 11/00; F41A 9/75; F41A 9/69; F41A 9/67; F41A 9/61; F41A 33/06; F41A 33/00; F41A 17/38
USPC ..... 124/56, 60, 71, 72
See application file for complete search history.

NON-LETHAL GAS OPERATED GUN

CROSS-REFERENCE TO RELATED APPLICATIONS

This application is a national stage of PCT/US2022/035532 filed Jun. 29, 2022 which claims the benefit of U.S. Provisional Application No. 63/218,262 filed Jul. 6, 2021, which is hereby incorporated by reference.

FIELD OF THE INVENTION

This application relates to non-lethal gas-operated guns with magazines that hold and supply non-lethal projectiles to be fed automatically to the chamber of a non-lethal gas operated gun.

This application incorporates by reference U.S. patent application Ser. No. 16/193,304 filed Nov. 16, 2018 and Ser. No. 15/690,179 filed Aug. 29, 2017. This application discloses improvements to these applications. In the event of a conflict between this application and U.S. patent application Ser. Nos. 16/193,304 and/or 15/690,179, the disclosure and claims in the present application supersede the disclosure and claims in U.S. patent application Ser. Nos. 16/193,304 and 15/690,179.

BACKGROUND

Disclosed in this application are improvements to the non-lethal gas-operated gun disclosed in U.S. patent application Ser. No. 16/193,304 filed Nov. 16, 2018 and Ser. No. 15/690,179 filed Aug. 29, 2017. The improvements include improvements in the feeding of rounds into the non-lethal gas-operated gun, improvements to the magazine latching mechanism, and improvements to the pre-pack.

DETAILED DESCRIPTION OF THE DRAWINGS

Figure 1:
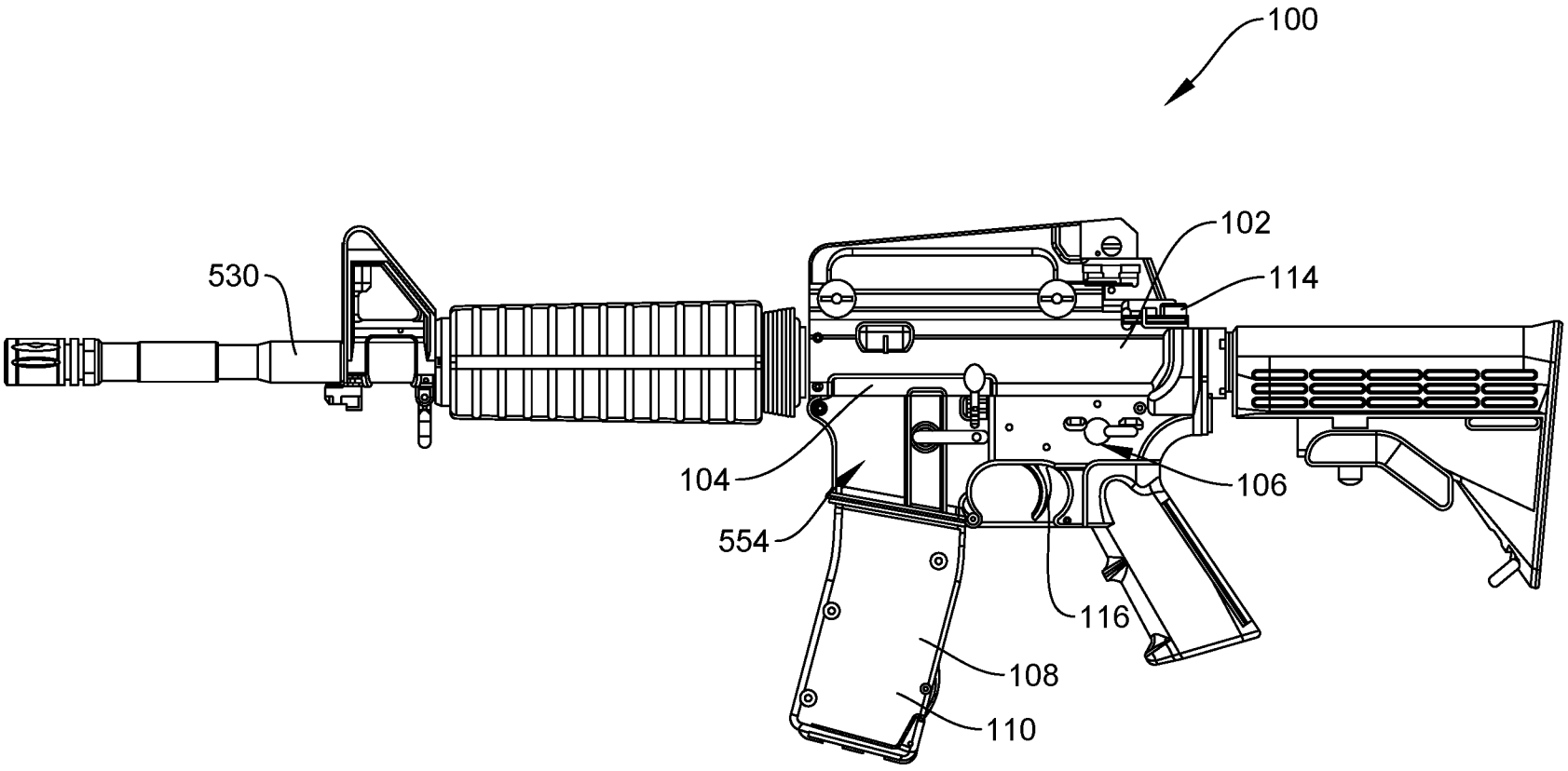
FIG. 1 is a side view of a gas operated gun.

For the purpose of promoting an understanding of the principles of the claimed invention, reference will now be made to the embodiments illustrated in the drawings and specific language will be used to describe the same. It will nevertheless be understood that no limitation of the scope of the claimed invention is thereby intended. Any alterations and further modifications in the described embodiments, and any further applications of the principles of the claimed invention as described herein are contemplated as would normally occur to one skilled in the art to which the claimed invention relates. One embodiment of the claimed invention is shown in great detail, although it will be apparent to those skilled in the relevant art that some features that are not relevant to the present claimed invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "left", "right", "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

In the description given below and or the corresponding set of drawing figures, when it is necessary to distinguish the various members, elements, sections/portions, components, parts, or any other aspects (functional or otherwise) or features or concepts or operations of a device(s) or method(s) from each other, the description and or the corresponding drawing figures may follow reference numbers with a small alphabet character such as (for example) "magazine 108*a*, 108*b*, and etc." If the description is common to all of the various members, elements, sections/portions, components, parts, or any other aspects (functional or otherwise) or features or concepts or operations of a device(s) or method(s) such as (for example) to all magazines 108*a*, 108*b*, etc., then they may simply be referred to with reference number only and with no alphabet character such as (for example) "magazine 108." Reference numbers are in general common with U.S. patent application Ser. No. 16/193,304.

Throughout the disclosure, references to M4, M16, or other conventional rifles or variants thereof are meant as illustrative, for convenience of example, and for discussion purposes only and should not be limiting. Further, for ease of understanding, throughout the disclosure, the variant M4 will be mentioned as the one, non-limiting, non-exhaustive example of a conventional weapon for M4 and its variants, M16 and its variant or others instead of specifically mentioning each individually.

Throughout the disclosure the use of the term non-lethal projectile(s) is defined as a non-lethal object propelled through the air by the non-lethal gas-operated gun, non-limiting, non-exhaustive listings of examples of non-lethal projectile(s) may include non-lethal round(s), BB(s), paintball(s), or the like.

The term "pre-pack" means "prepackaged."

While the various improvements disclosed herein are disclosed in relation to a single firearm that includes each of the improvements, it should be understood that each improvement is separable from other improvements and can each be independently implemented.

Figure 2:
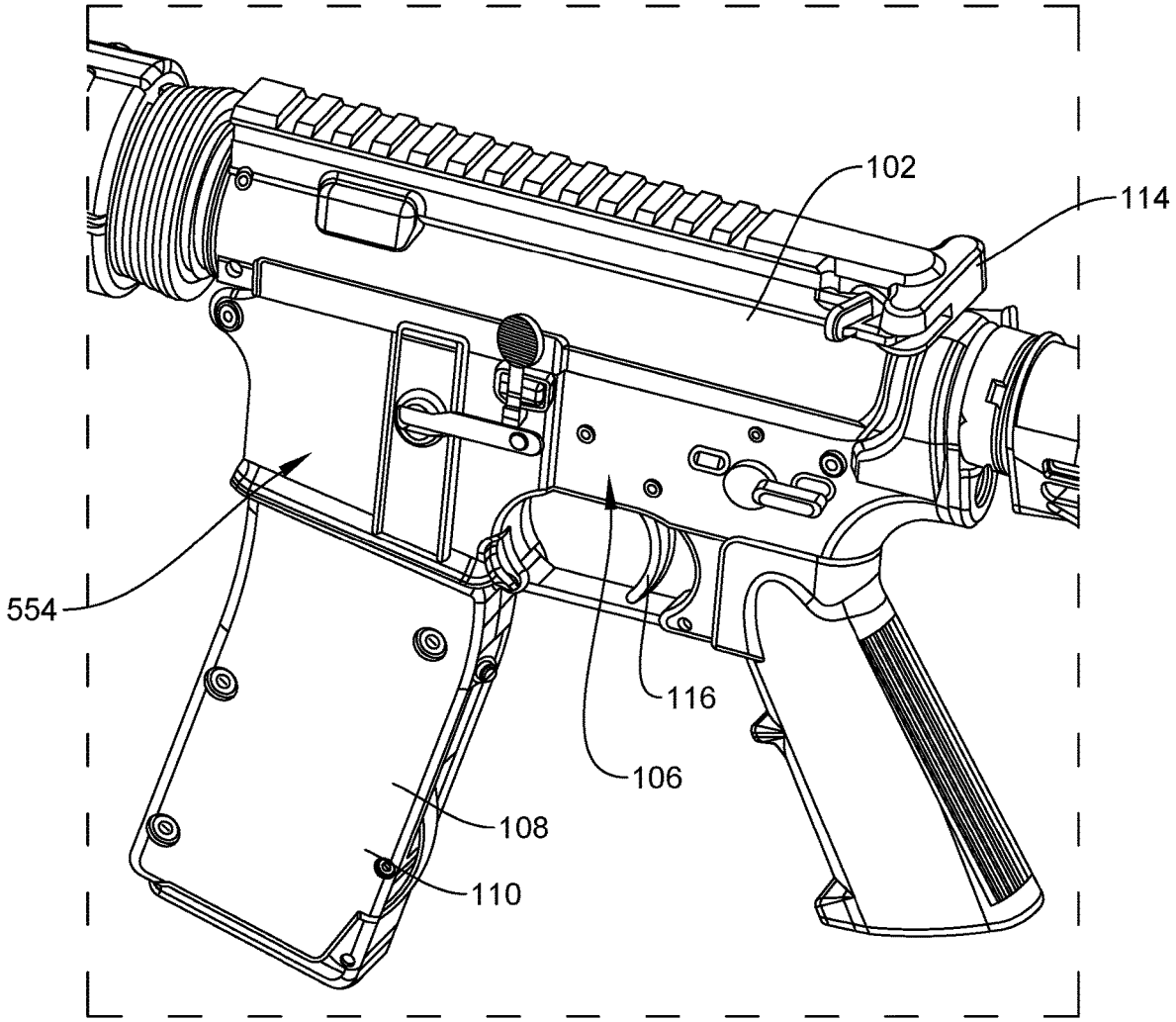
FIG. 2 is a perspective view of the upper and lower receiver of the FIG. 1 gas operated gun.
Figure 3:
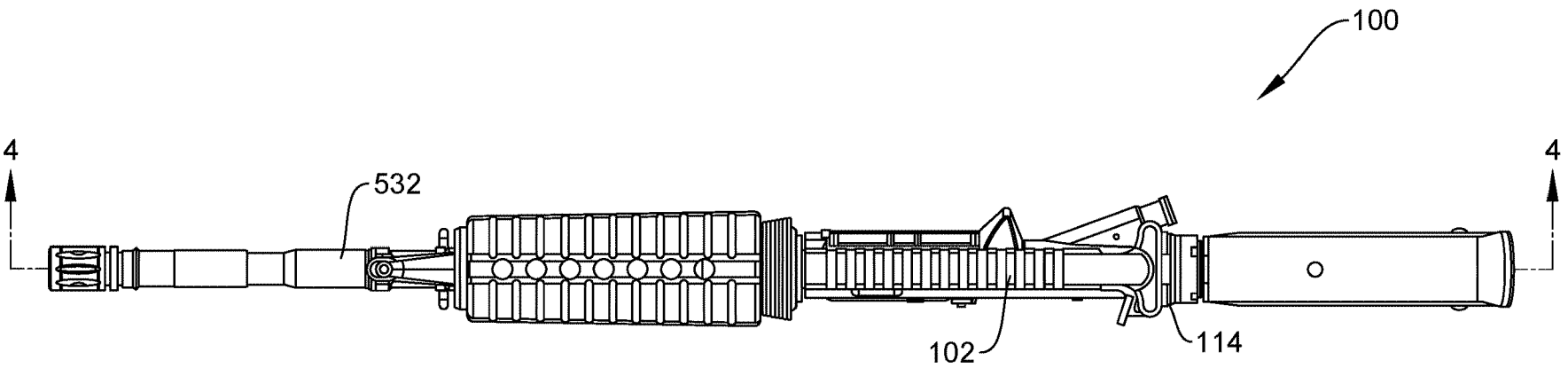
FIG. 3 is a top view of the FIG. 1 gas operated gun.
Figure 4:
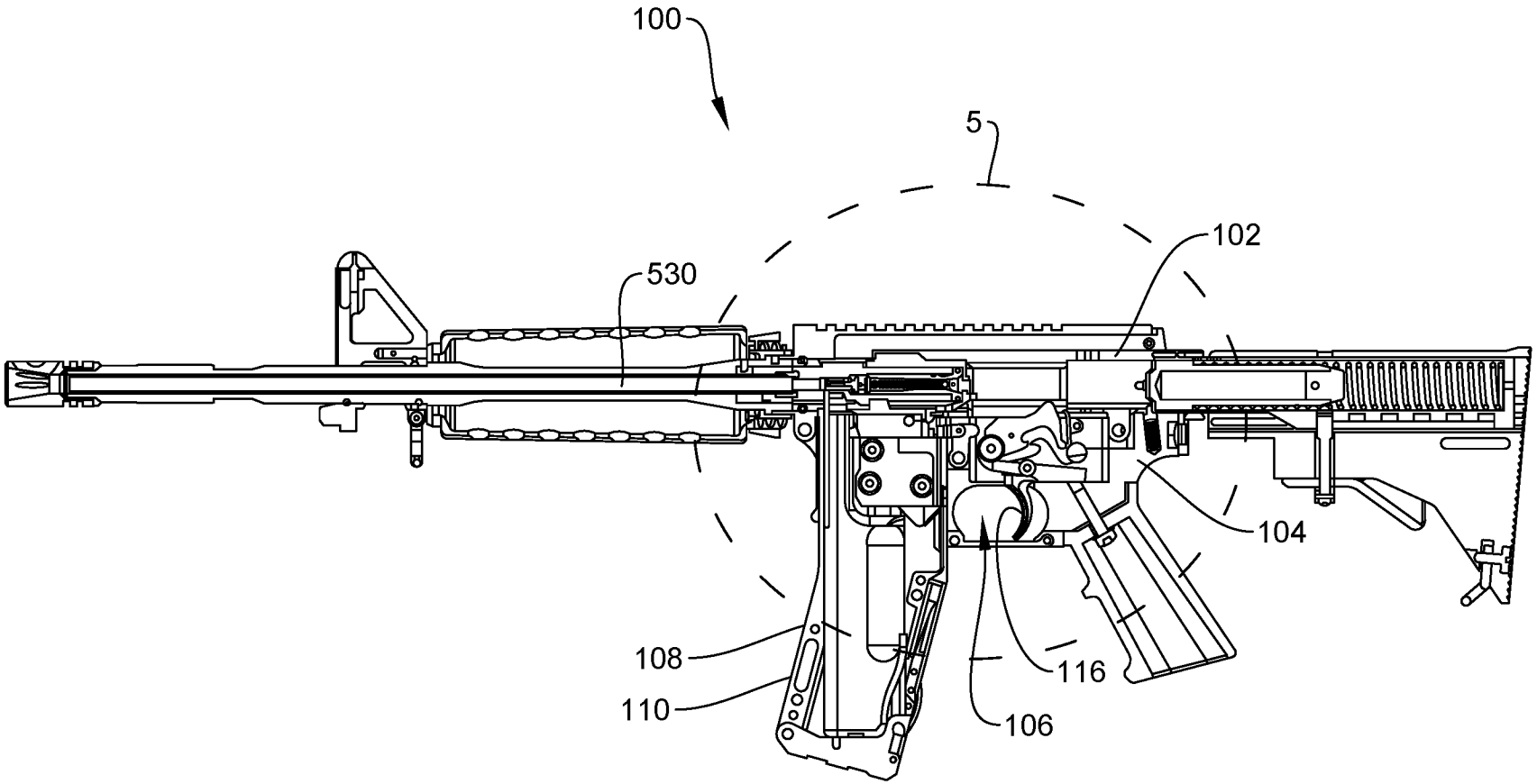
FIG. 4 is a cross sectional side view of the FIG. 1 gas operated gun taken along line 4-4 in FIG. 3.

FIGS. 1-3 are illustrations of non-lethal gas-operated gun 100. Non-lethal gas-operated gun 100 generally includes upper receiver assembly 102 (includes bolt carrier group 504 and other components) and a lower receiver assembly 104 (which includes trigger group 106 and other components) that accommodate spherical non-lethal projectiles rather than live ammunition.

Non-lethal gas-operated gun 100 also includes magazine 108, that holds and supplies non-lethal projectiles fed to the chamber of non-lethal gas-operated gun 100 (located in the upper assembly 102) through the cyclic action of the reciprocal bolt (detailed below). Housing 110 of magazine 108 is made to look, feel, and be experienced similar to a magazine of a conventional rifle such as the conventional live-fire M4 and its variants. Lower receiver assembly 104 includes opening 554 (also known as the "magazine well") through which magazine 108 is inserted and detachably secured with non-lethal gas-operated gun 100 in a well-known manner.

Non-lethal gas-operated gun 100 further includes charging handle 114, and barrel 530.

The look, feel, experience, and use of non-lethal gas-operated gun 100 is very similar to that of an M4 or M16 rifle and their respective variants (such as the M4 carbine). For example, in order to use non-lethal gas-operated gun 100, magazine 108 is inserted into lower receiver 104 in the same manner as is done on an M4 rifle. The next operational act prior to firing non-lethal gas-operated gun 100 is to simply pull charging handle 114 of non-lethal gas-operated gun 100, similar to a conventional M16 variant rifle. Once the charging handle 114 is pulled, user simply fires rifle 100 by pulling trigger 116 of trigger group 106.

Regarding the actual feel and experience of non-lethal gas-operated gun 100 when it does fire non-lethal projectiles, non-lethal gas-operated gun 100 provides the same feel and experience as a well-known conventional Gas Blow Back (GBB) rifle.

Non-lethal gas-operated gun 100 uses pressure-regulated carbon dioxide ($CO_2$) gas, detailed below, to fire non-lethal projectiles (facilitated by GBB) and hence, users experience the same jerking or "kick" motion as for example, the conventional live-fire M4. It should be noted that GBB mechanism serves the purpose of providing recoil, but most importantly, a new round is chambered through the gun's GBB action.

Figure 5:
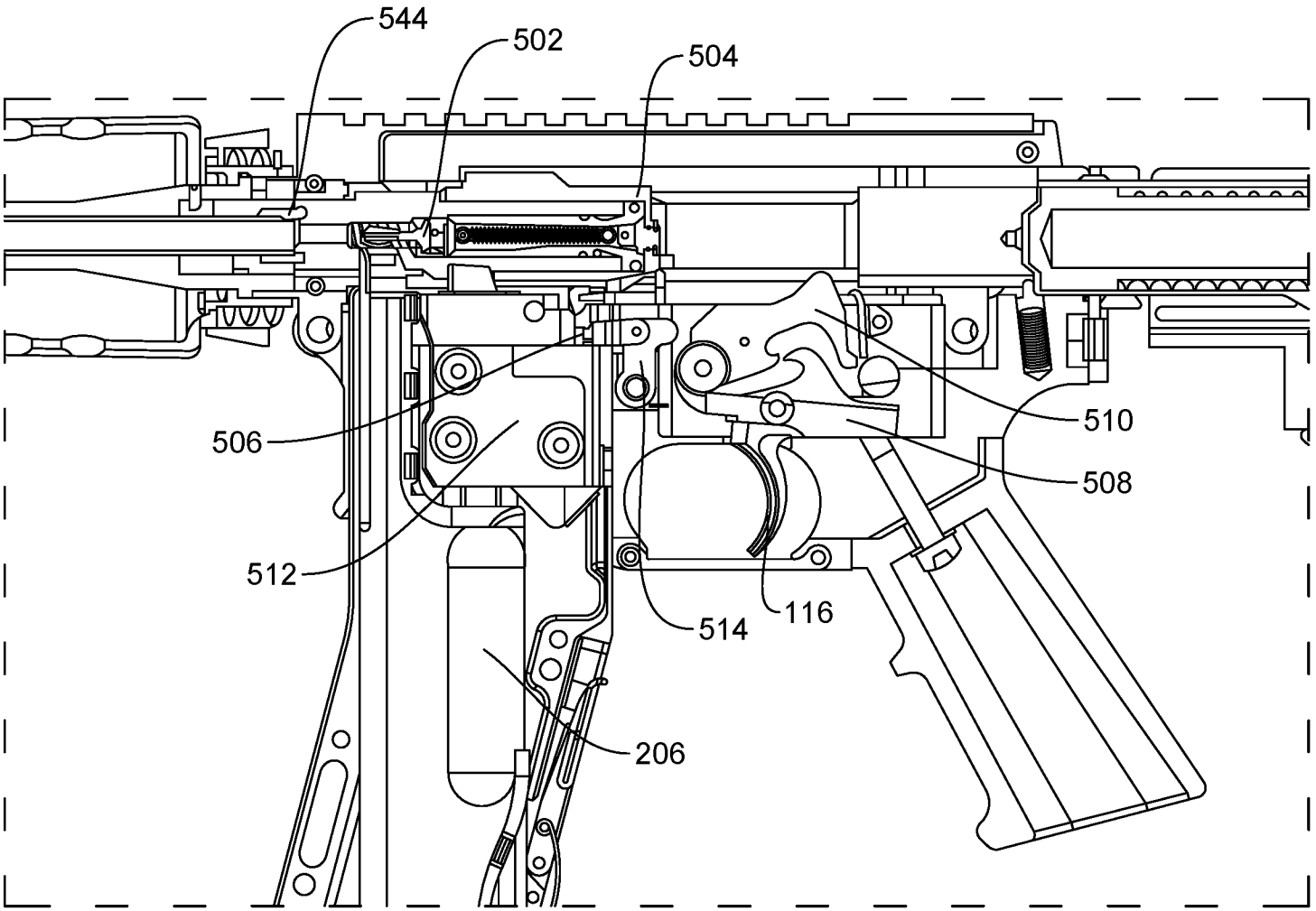
FIG. 5 is an enlarged view of the cross section of the upper and lower receiver shown in FIG. 4.
Figure 5A:
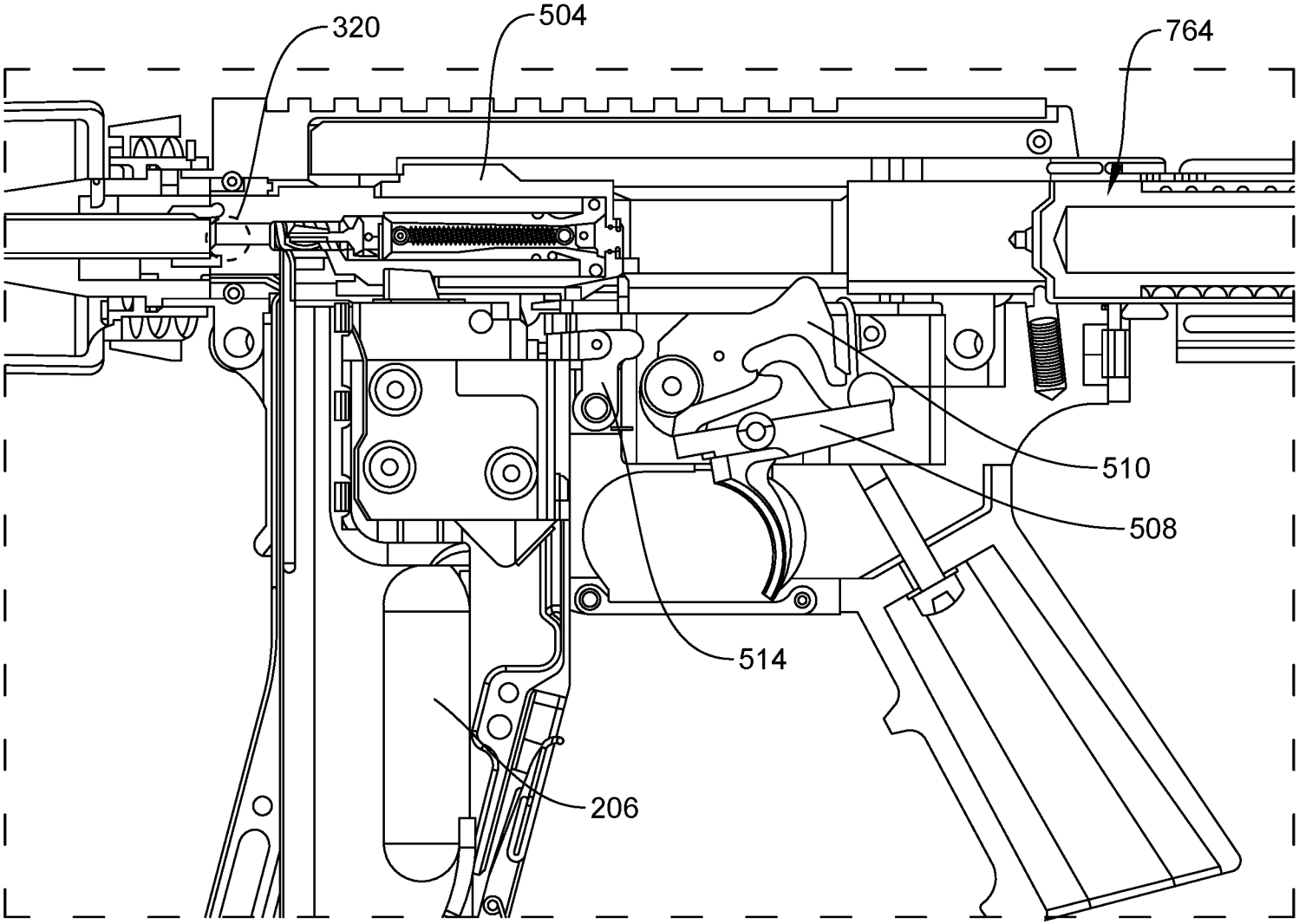
FIG. 5A is the view of the cross section of the upper and lower receiver shown in FIG. 5 with the trigger pulled and the hammer initially released.
Figure 5B:
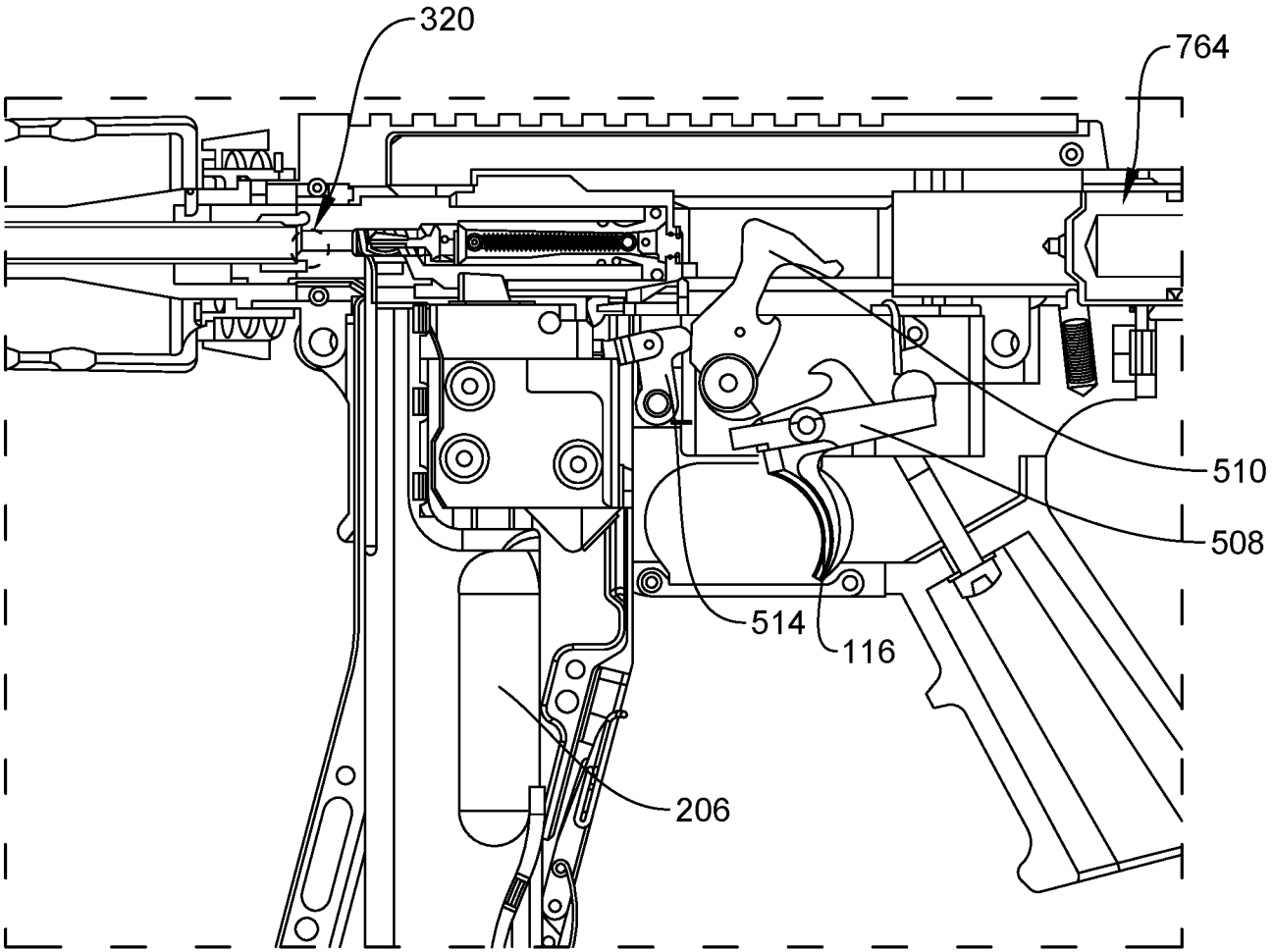
FIG. 5B is the view of the cross section of the upper and lower receiver shown in FIG. 5 with the hammer released and moving due the biasing force of a hammer spring.
Figure 5C:
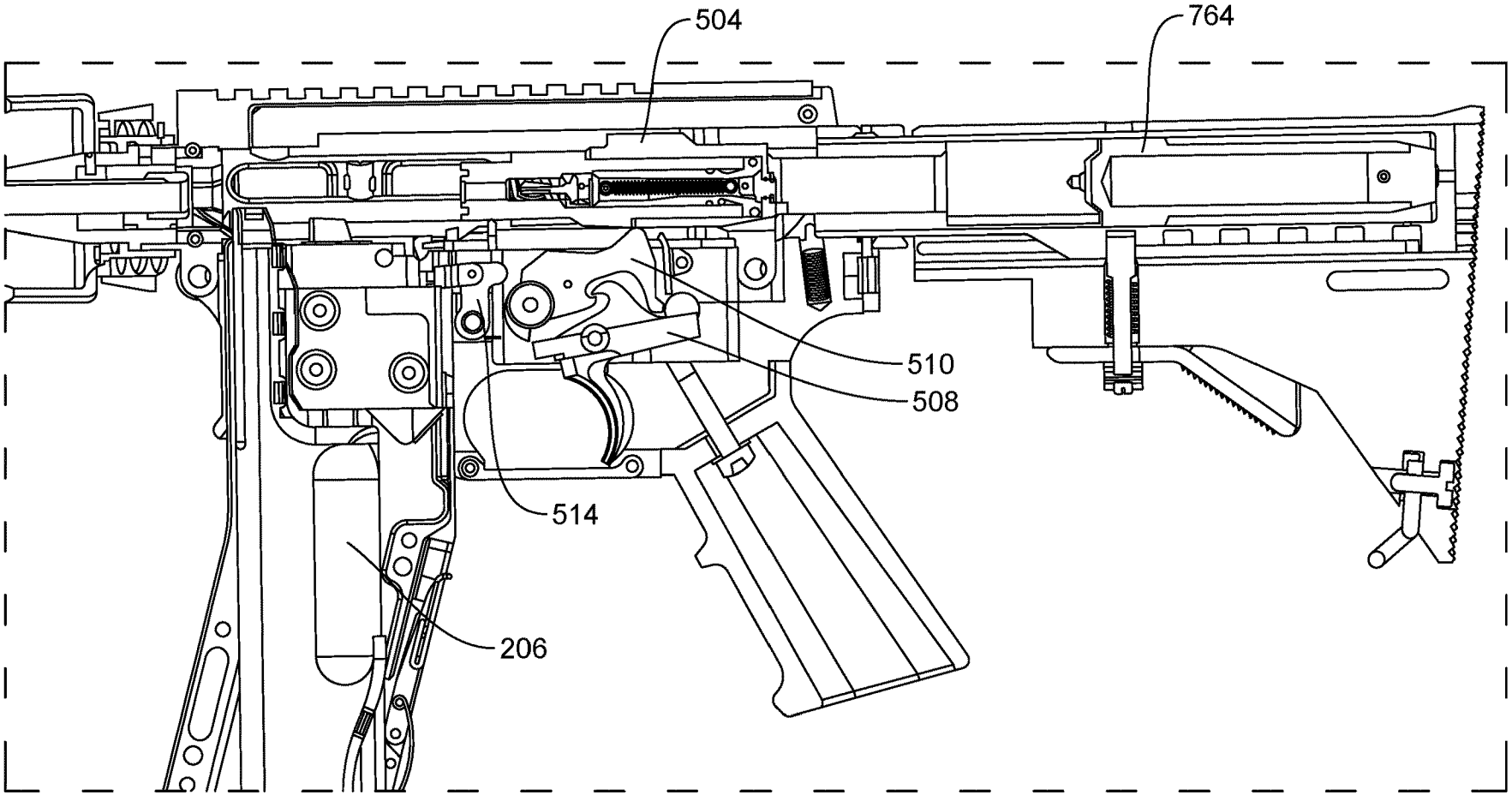
FIG. 5C is the view of the cross section of the upper and lower receiver shown in FIG. 5 with the bolt positioned at a point near maximum blowback.
Figure 5D:
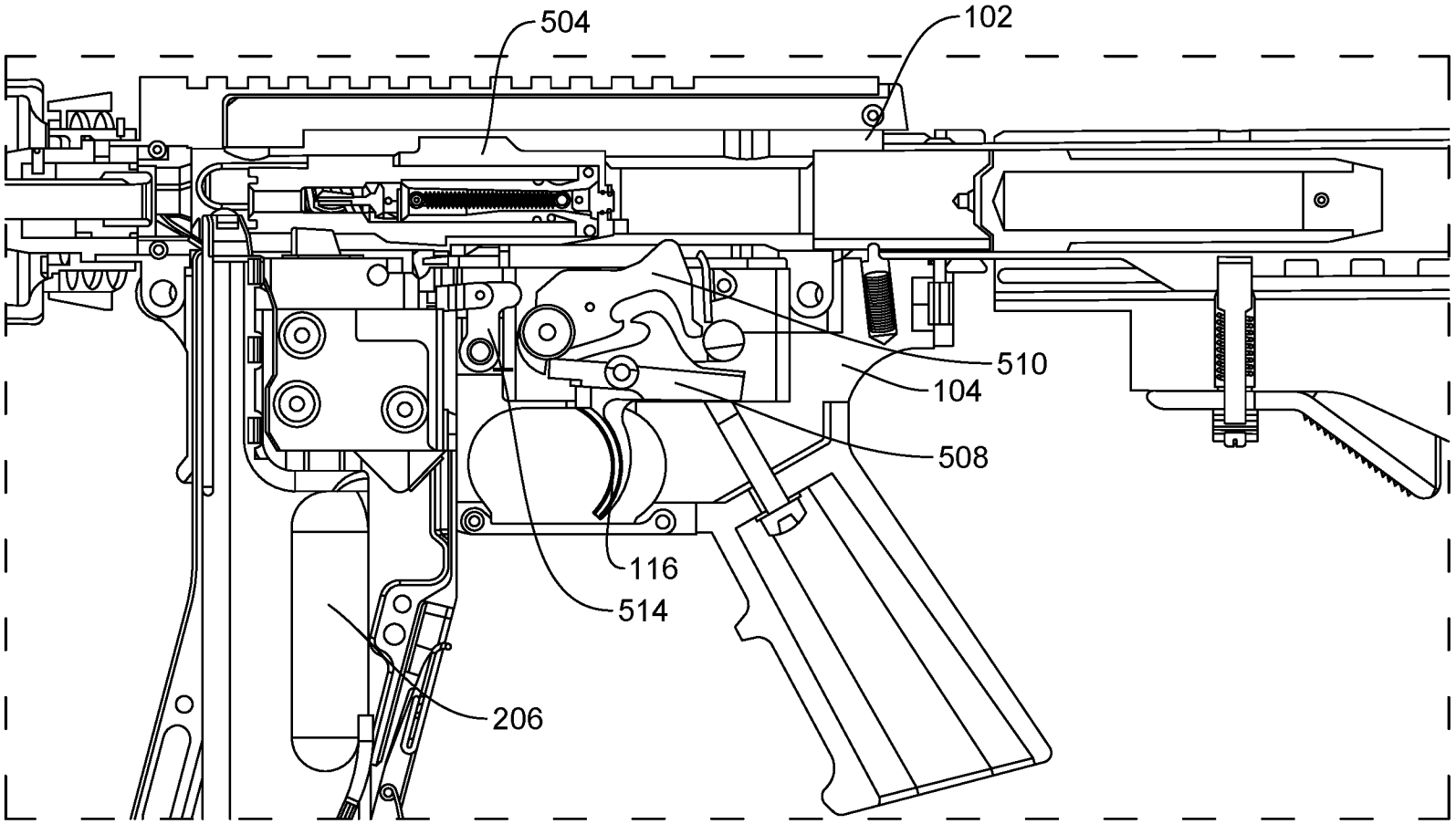
FIG. 5D is the view of the cross section of the upper and lower receiver shown in FIG. 5 with the bolt moving forward from the position in FIG. 5C under the biasing force of a buffer spring with the bolt beginning to strip a new round from the magazine.
Figure 6B:
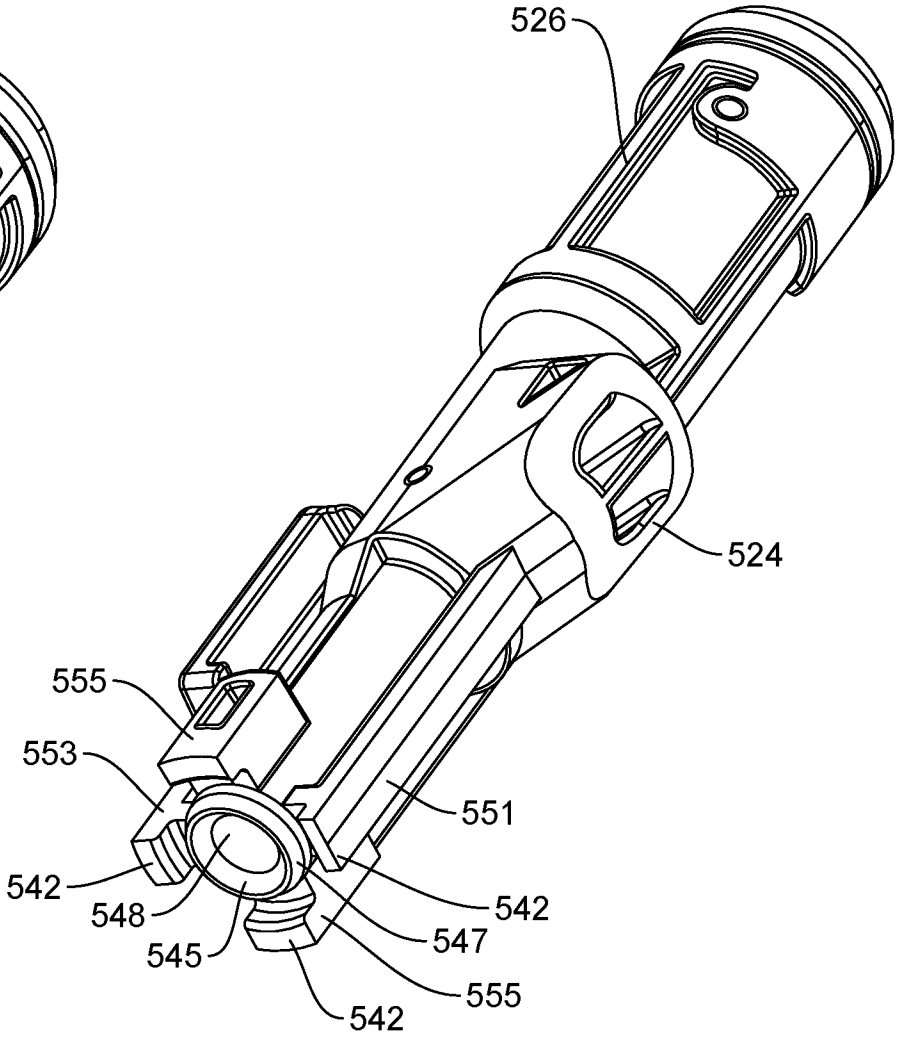
FIG. 6B illustrates a top perspective view of the FIG. 6A bolt.
Figure 6A:
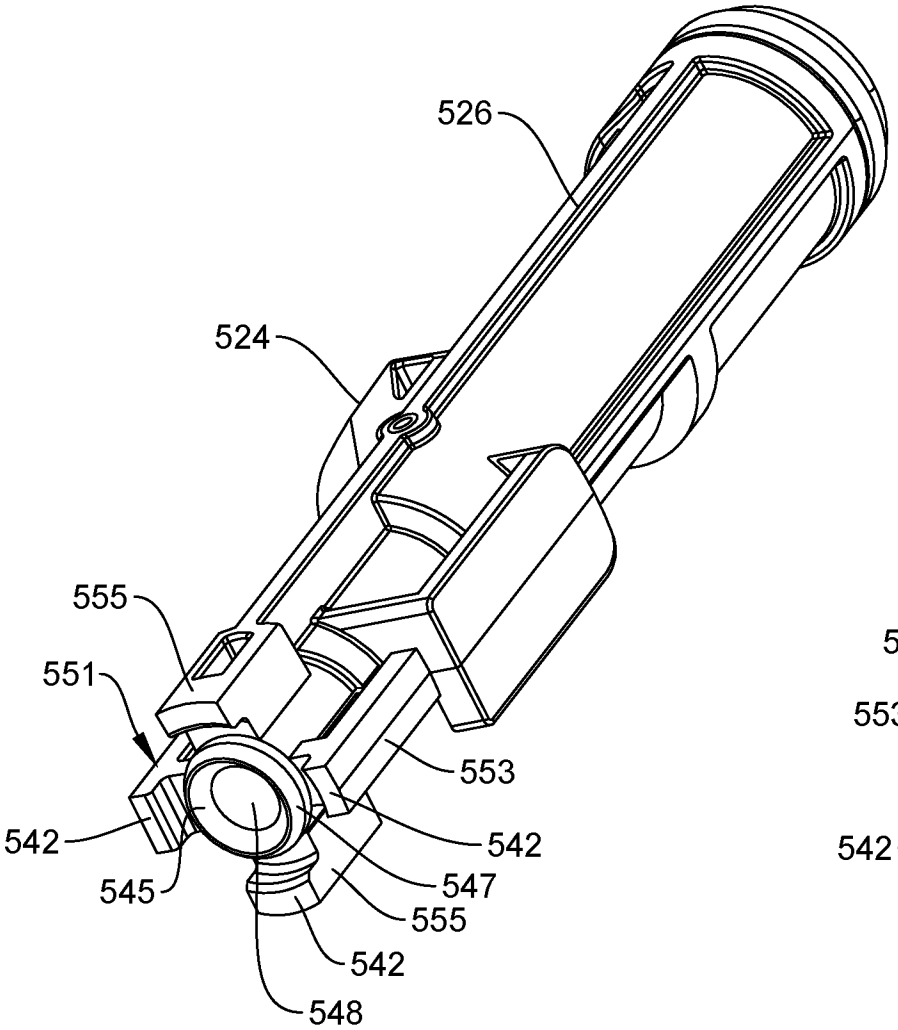
FIG. 6A illustrates a bottom perspective view of a bolt, a component of the FIG. 1 gas operated gun.
Figure 6E:
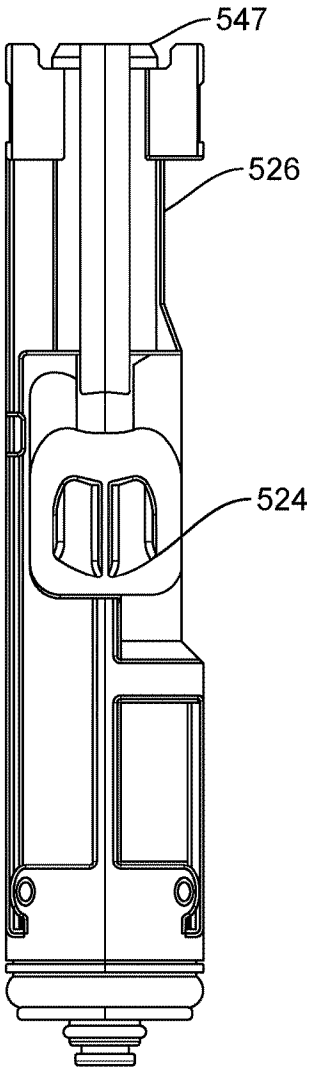
FIG. 6E illustrates a top view of the FIG. 6A bolt.
Figure 6D:
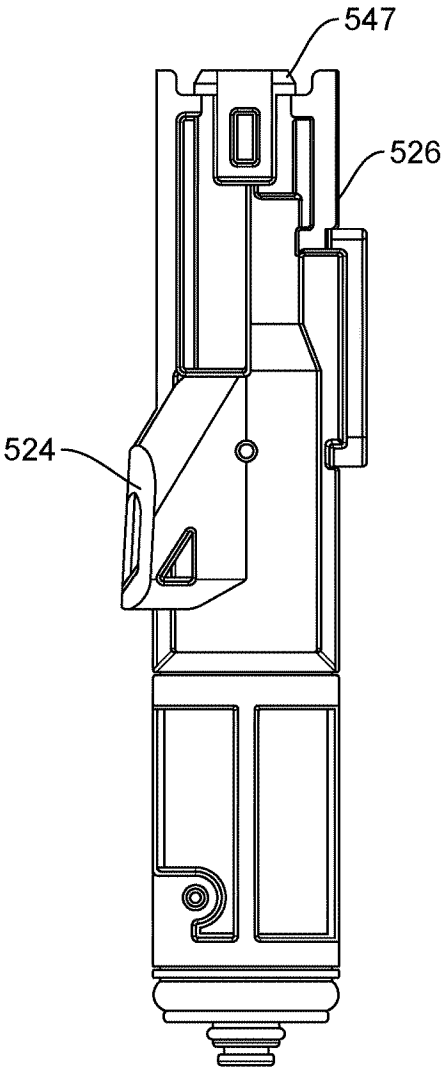
FIG. 6D illustrates a bottom view of the FIG. 6A bolt.
Figure 6C:
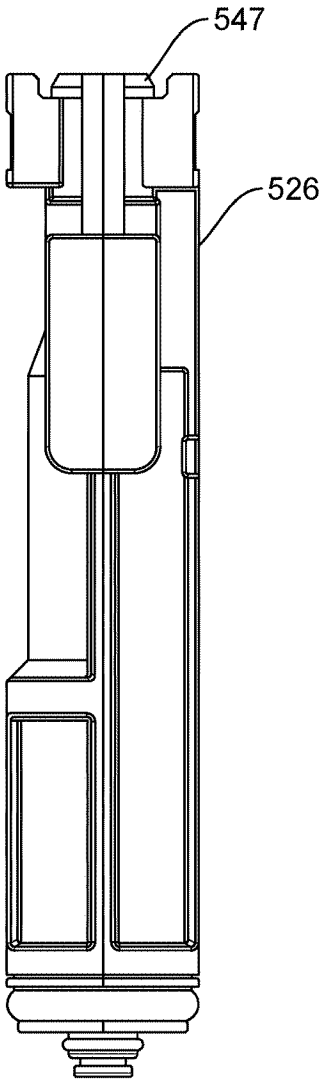
FIG. 6C illustrates a bottom view of the FIG. 6A bolt.
Figure 6G:
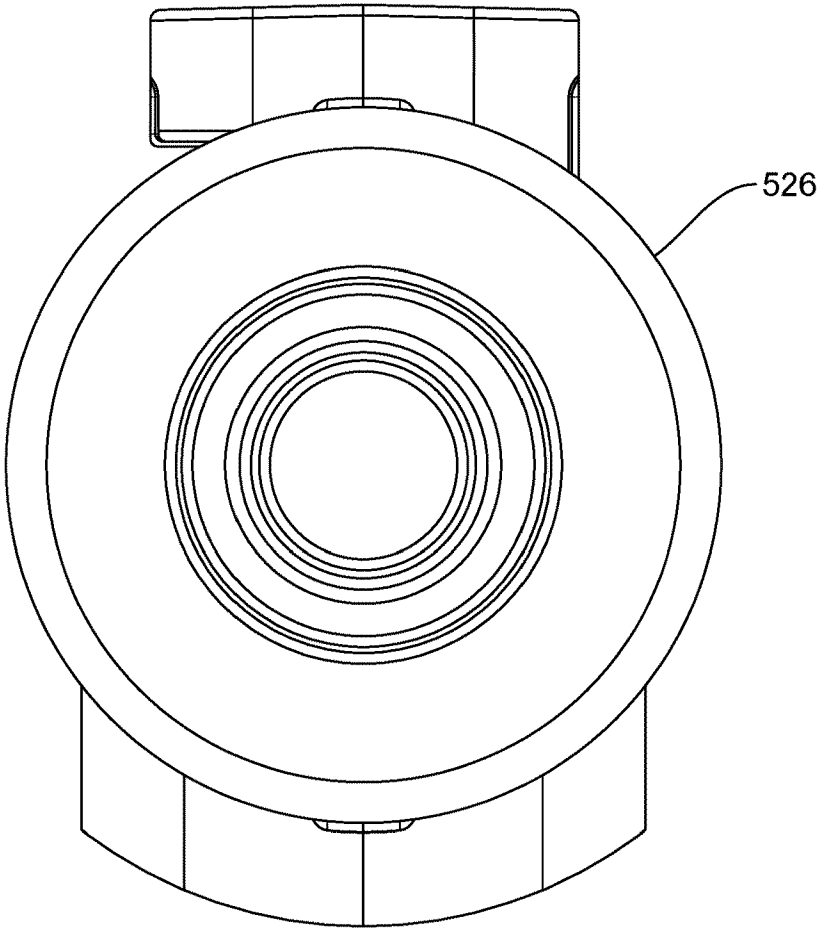
FIG. 6G illustrates a rear view of the FIG. 6A bolt.
Figure 6F:
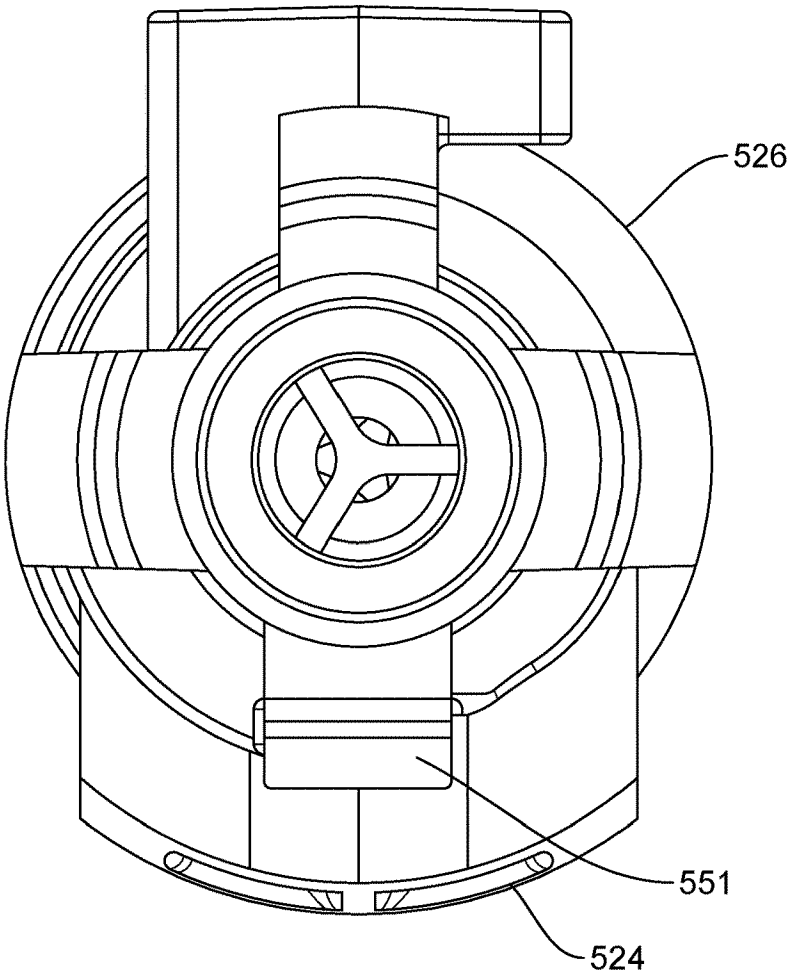
FIG. 6F illustrates a front view of the FIG. 6A bolt.
Figure 7C:
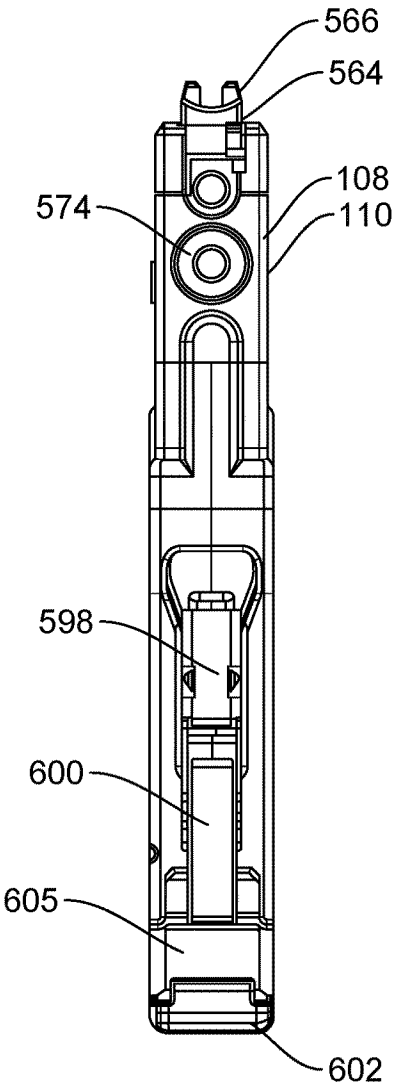
FIG. 7C illustrates a rear view of the FIG. 7A magazine.
Figure 7B:
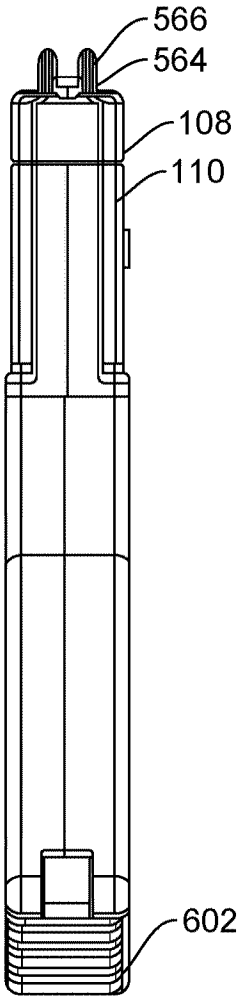
FIG. 7B illustrates a front view of the FIG. 7A magazine.
Figure 7A:
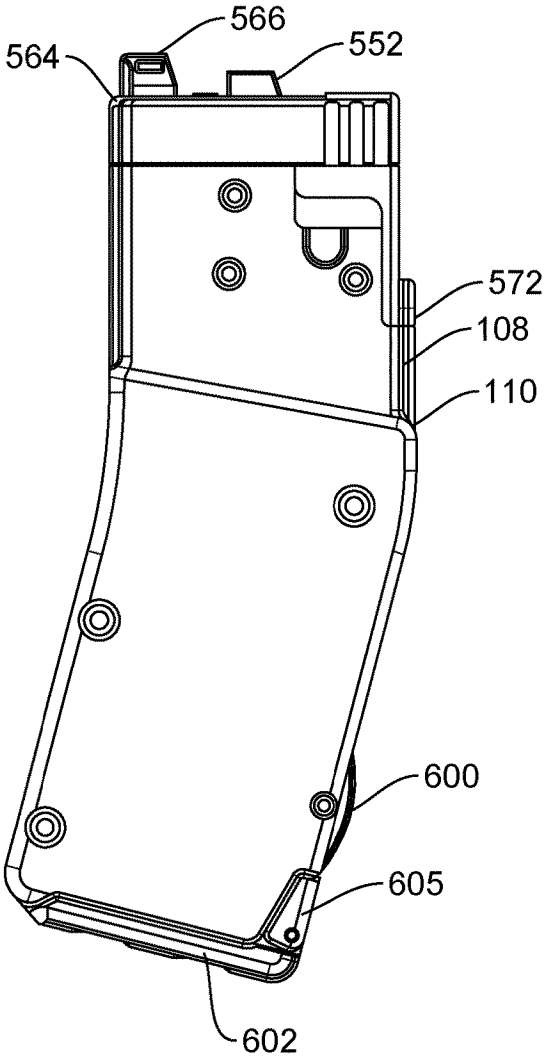
FIG. 7A illustrates a side view of a magazine, a component of the FIG. 1 gas operated gun.
Figure 7F:
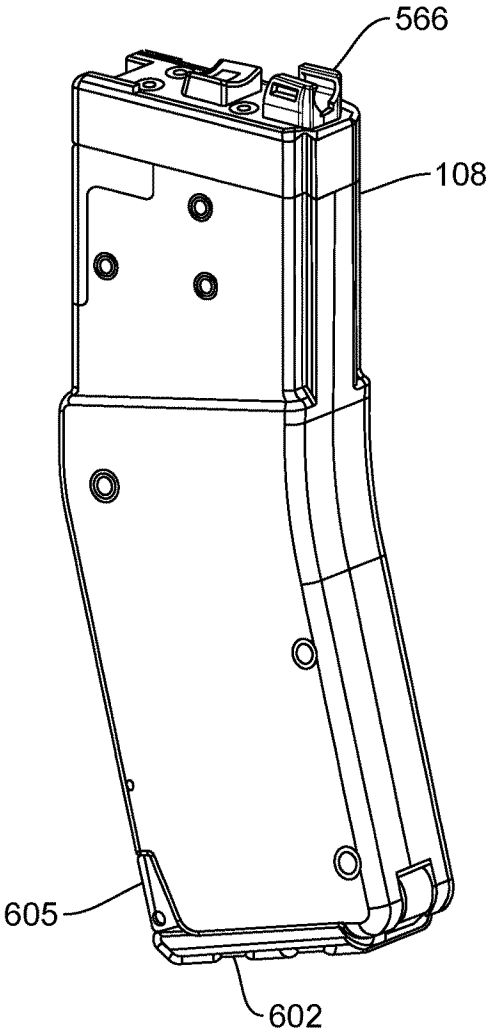
FIG. 7F illustrates a front perspective view of the FIG. 7A magazine.
Figure 7E:
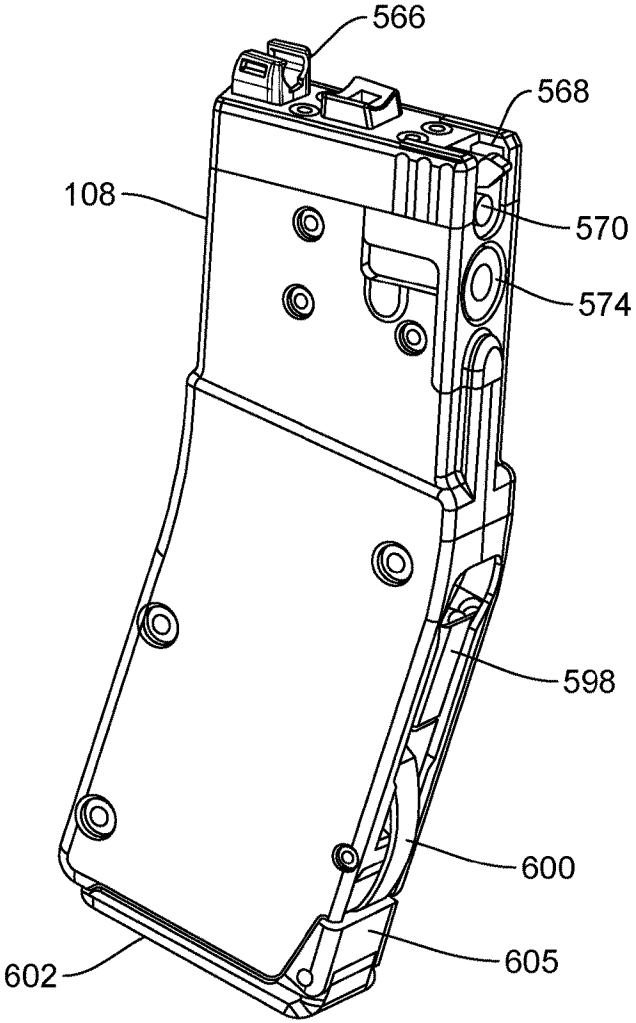
FIG. 7E illustrates a rear perspective view of the FIG. 7A magazine.
Figure 7D:
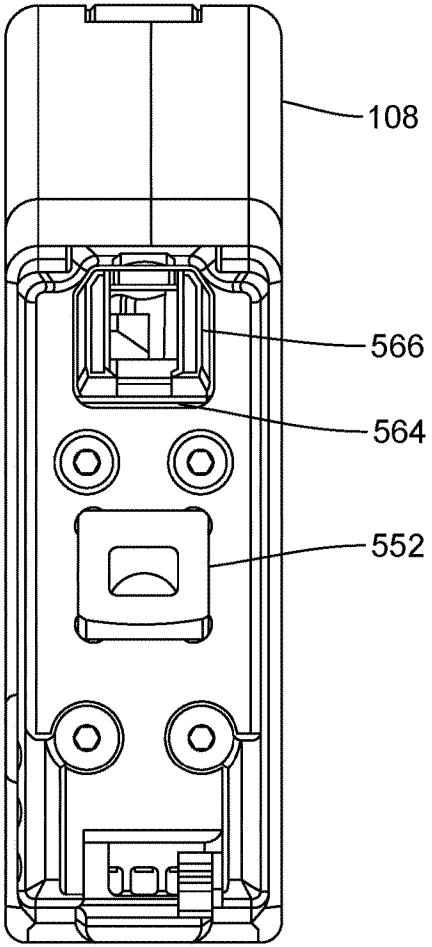
FIG. 7D illustrates a top view of the FIG. 7A magazine.
Figure 7H:
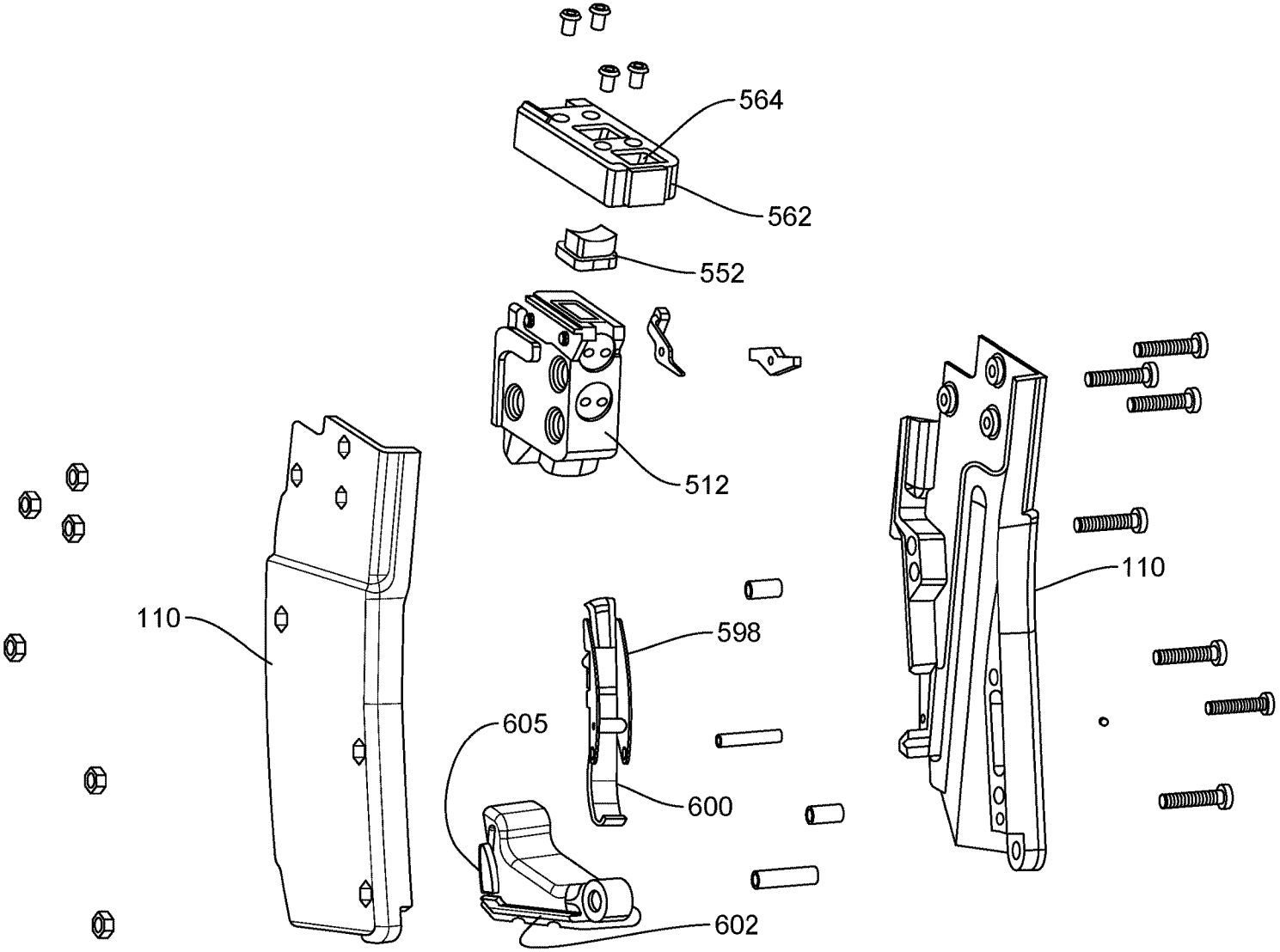
FIG. 7H illustrates an assembly view of the FIG. 7A magazine.
Figure 8:
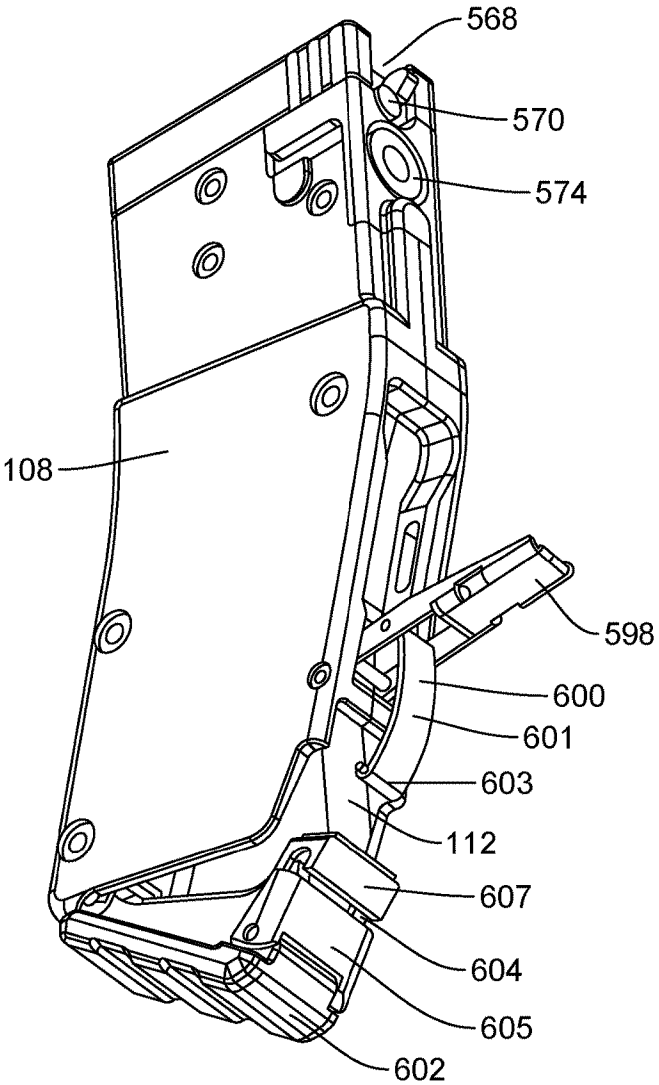
FIG. 8 illustrates a bottom rear perspective view of the FIG. 7A magazine with a door partially open.
Figure 7G:
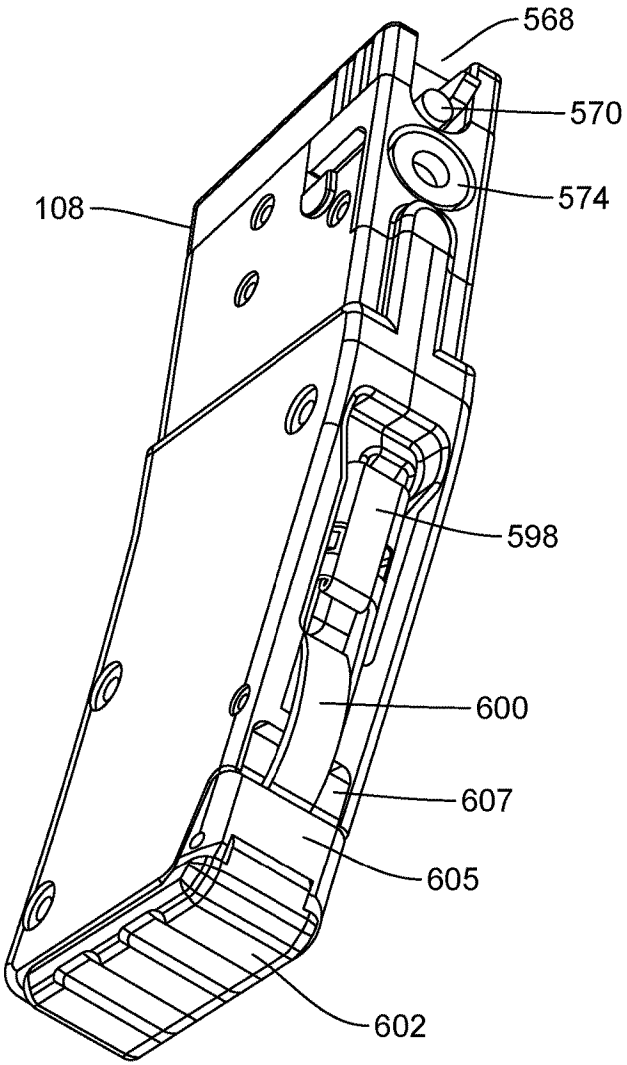
FIG. 7G illustrates a bottom rear perspective view of the FIG. 7A magazine.
Figure 9B:
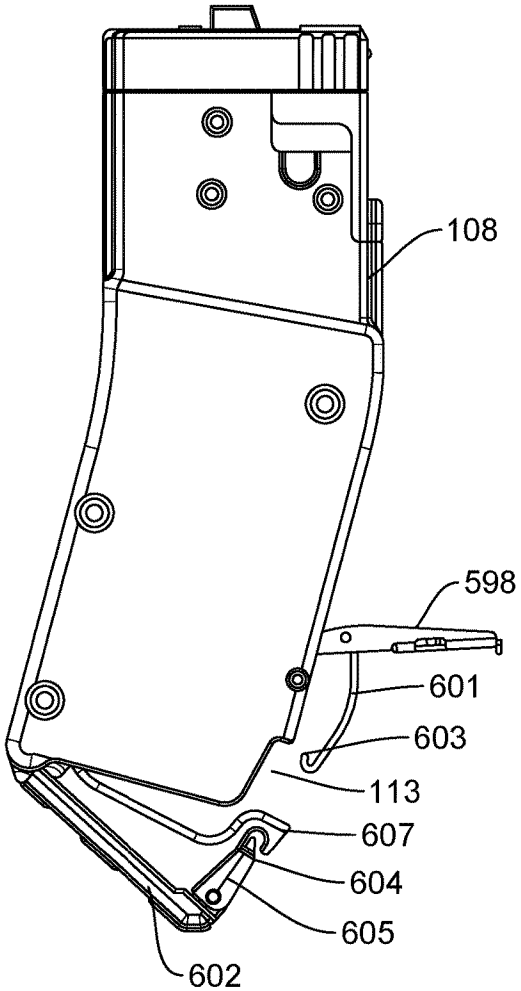
FIG. 9B illustrates a side view of the FIG. 7A magazine in an intermediate state of opening/closing the door on the magazine.
Figure 9A:
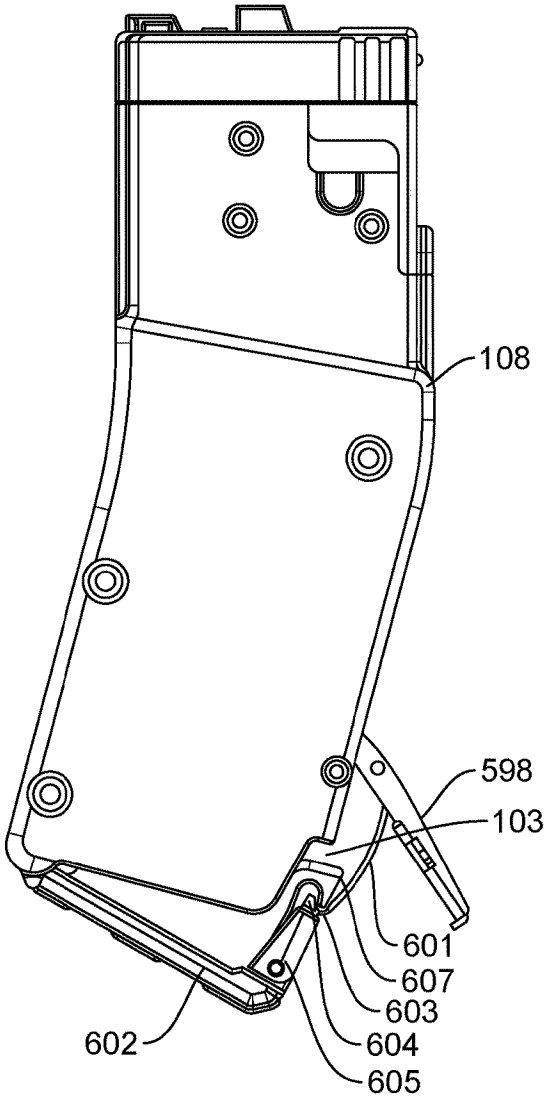
FIG. 9A illustrates a side view of the FIG. 7A magazine in an initial/final state of opening/closing the door on the magazine. '11awsw
Figure 9D:
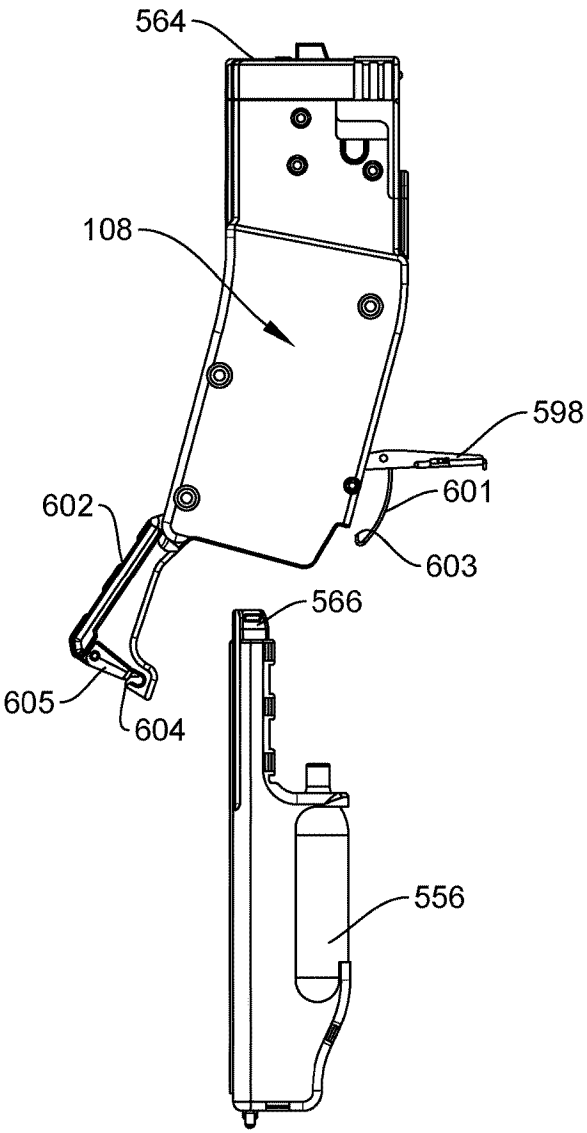
FIG. 9D illustrates a side view of the FIG. 7A magazine with the door opened and the pre-pack fully inserted/removed from the magazine.
Figure 9C:
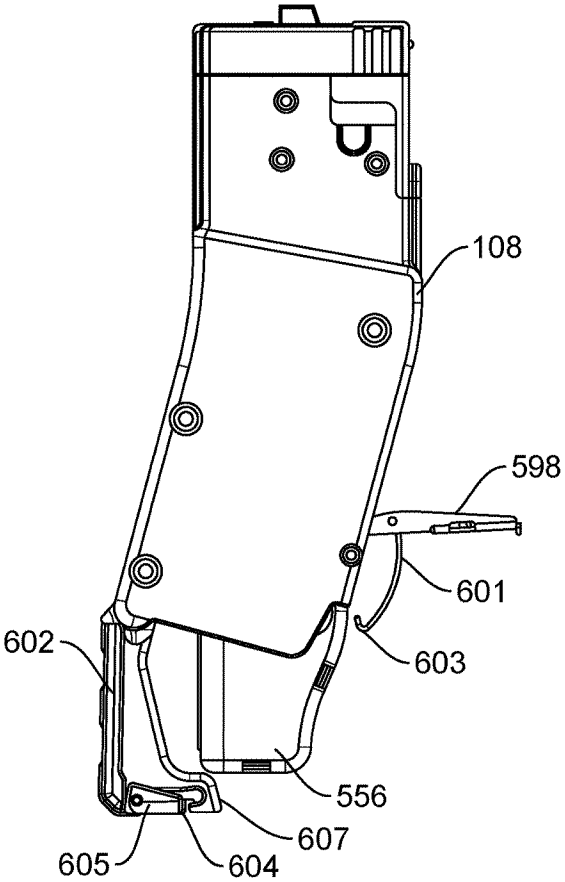
FIG. 9C illustrates a side view of the FIG. 7A magazine with the door mostly open with a pre-pack partially inserted/removed from the magazine.
Figure 10D:
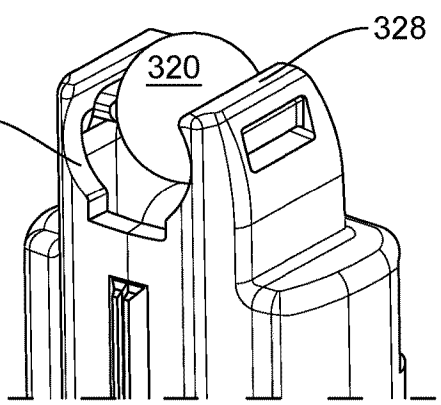
FIG. 10D is an enlarged view of the FIG. 10C view of the pre-pack.
Figure 10C:
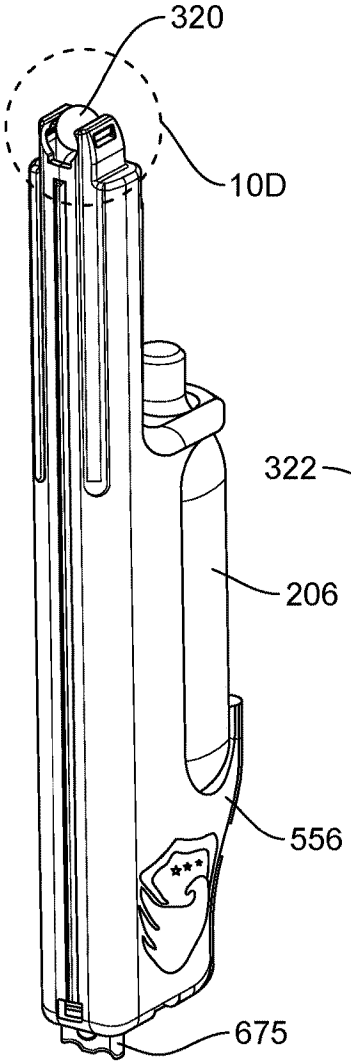
FIG. 10C is a front perspective view of the FIG. 10A pre-pack.
Figure 10B:
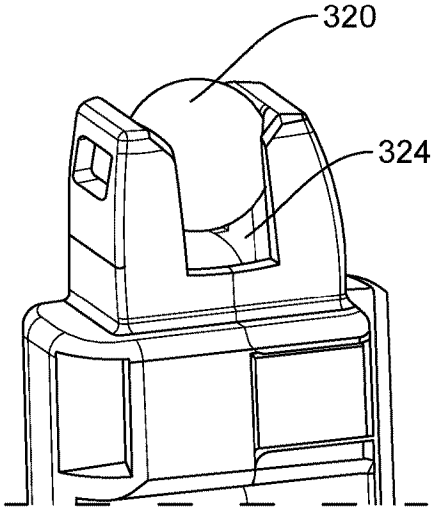
FIG. 10B is an enlarged view of the FIG. 10A pre-pack.
Figure 10A:
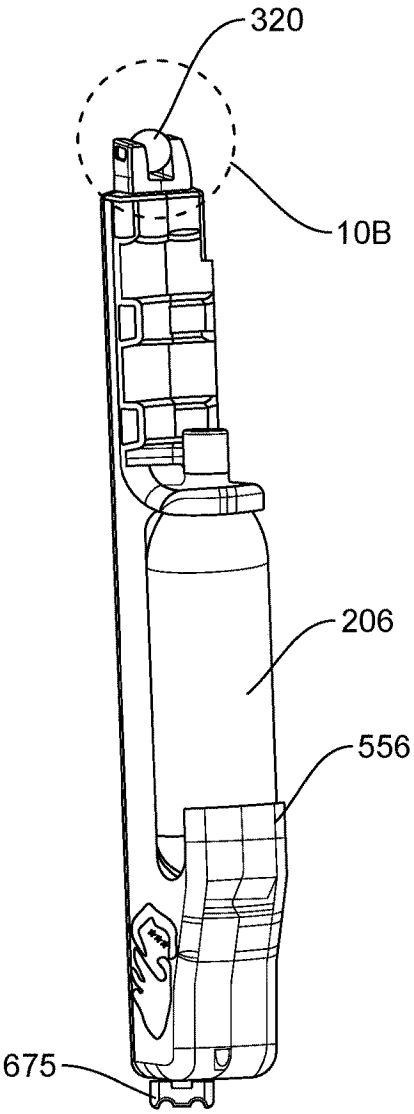
FIG. 10A is a rear perspective view of a pre-pack, a component of the FIG. 1 gas operated gun.
Figure 10G:
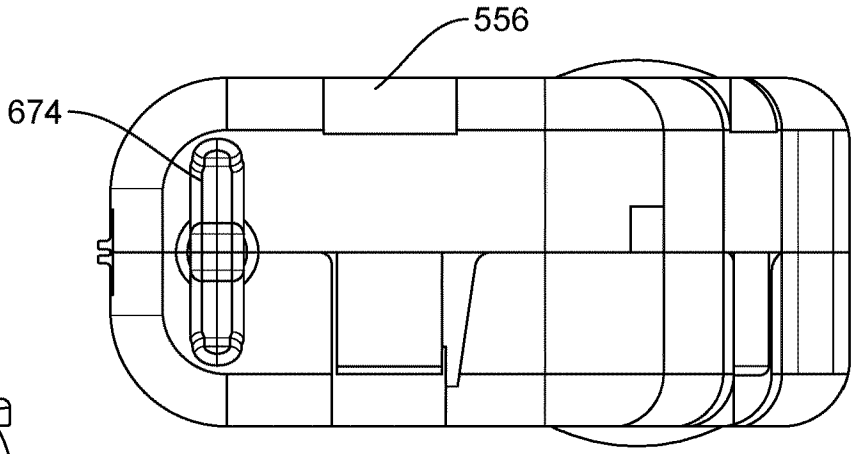
FIG. 10G is a bottom plan view of the FIG. 10A pre-pack.
Figure 10H:
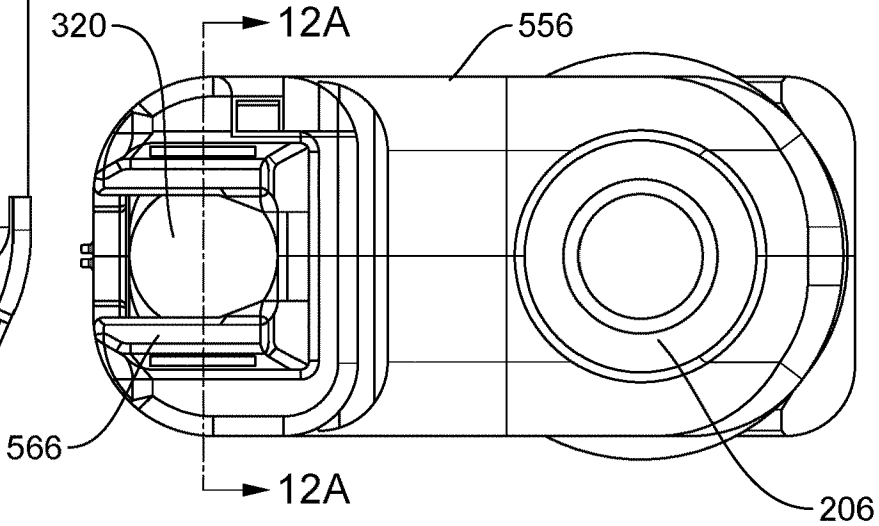
FIG. 10H is a top plan view of the FIG. 10A pre-pack.
Figure 10F:
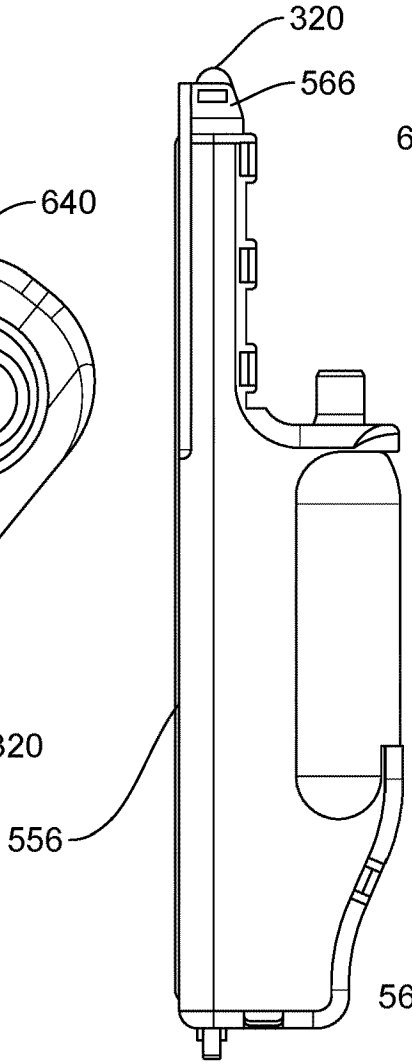
FIG. 10F is a side view of the FIG. 10A pre-pack.
Figure 10E:
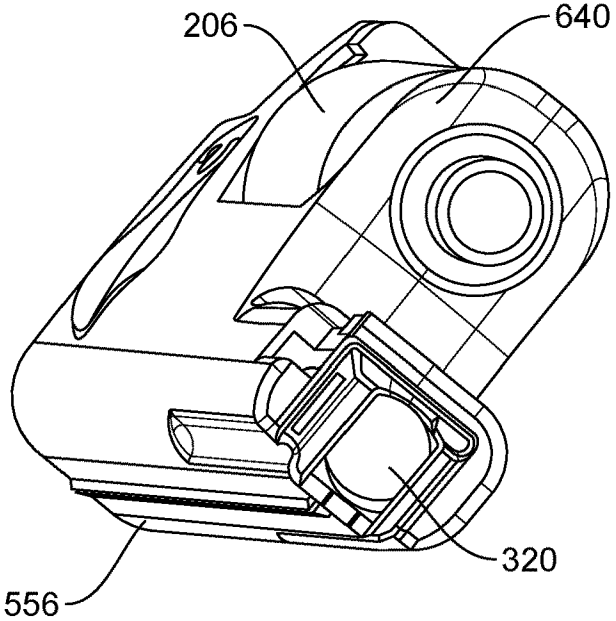
FIG. 10E is a top perspective view of the FIG. 10A pre-pack.
Figure 10K:
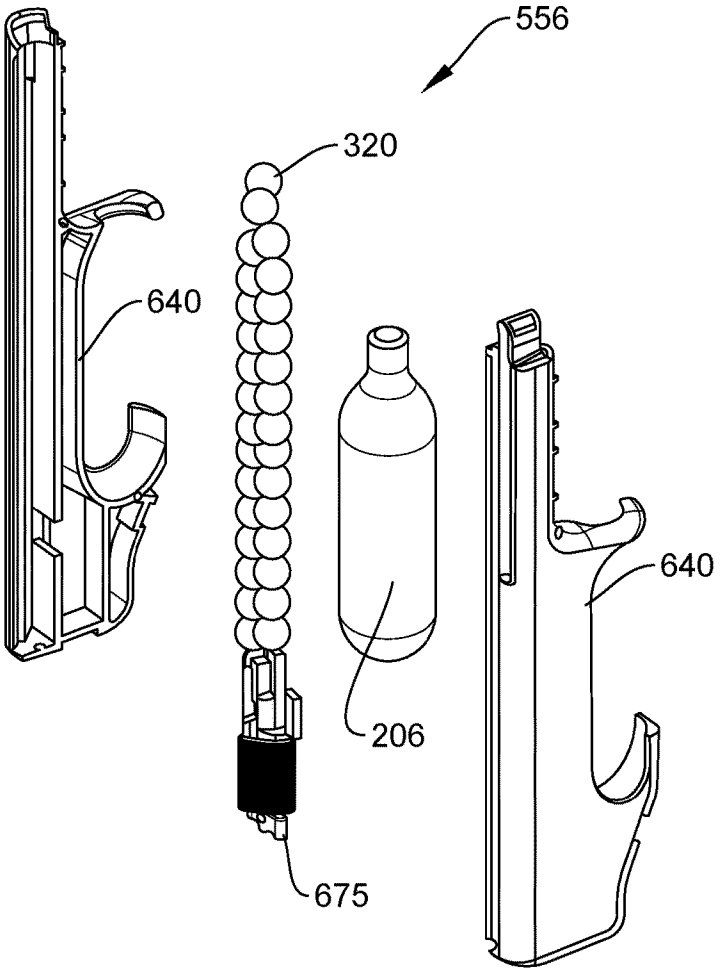
FIG. 10K is an assembly view of the FIG. 10A pre-pack.
Figure 10J:
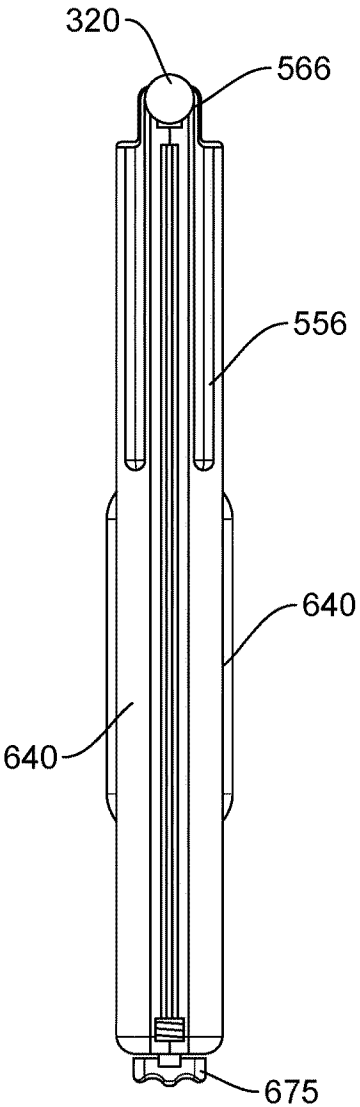
FIG. 10J is a front view of the FIG. 10A pre-pack.
Figure 10I:
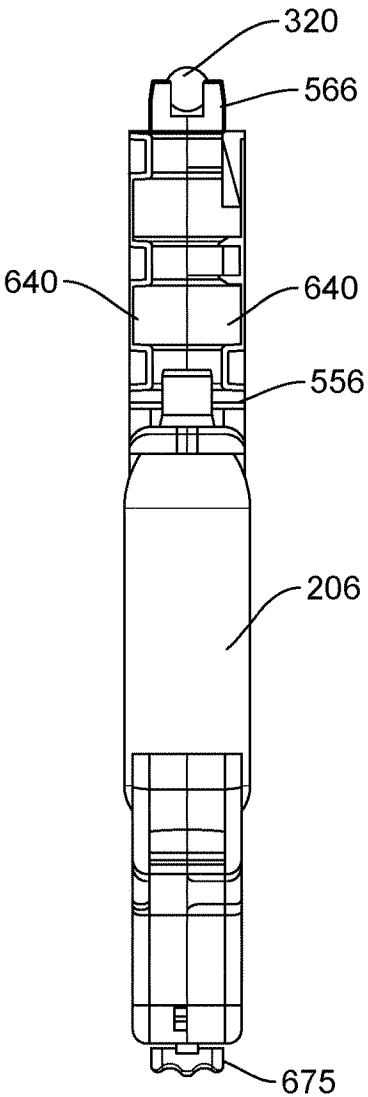
FIG. 10I is a rear view of the FIG. 10A pre-pack.

FIGS. 5A-5D are cross-sectional illustrations of several progressive stages of the operation of non-lethal gas-operated gun 100 showing the cyclic action of trigger group 106 and bolt carrier group 504 for holding, supplying, and firing of non-lethal projectiles. FIG. 5A illustrates non-lethal gas-operated gun 100 with trigger 116 pulled and hammer 510 initially released. FIG. 5B is the view of the cross section of the upper and lower receivers 102 and 104 with hammer 510 released and moving due the biasing force of a hammer spring. FIG. 5C is the view of the cross section of the upper and lower receivers 102 and 104 with bolt carrier group 504 positioned at a point near maximum blowback. FIG. 5D is the view of the cross section of the upper and lower receivers 102 and 104 with bolt carrier group 504 moving forward from the position in FIG. 5C under the biasing force of a buffer spring of buffer 764 with the bolt beginning to strip a new round 320 from magazine 108.

As illustrated in FIGS. 5A-5D, when trigger 116 is pulled, disconnector 508 pivots free of primary hammer 510, which also frees primary hammer 510 to swing forward and strike against secondary hammer 514. As secondary hammer 514 is struck by primary hammer 510, it also swings forward and strikes against a poppet valve 506 of gas regulator system 512 in magazine 108, releasing gas into bolt carrier group 504 propelling a non-lethal projectile 320. That is, when poppet valve 506 is actuated/depressed by secondary hammer 514, pressurized gas is released from gas reservoir 206 in magazine 108 and into bolt carrier group 504 via gas inlet 524 on bottom surface 528 of bolt 526.

After non-lethal projectile 320 exits bolt 526, rocket valve 502 pushes forward and blocks gas existing from front 528 of bolt 526 and through barrel 530. This closure of front 528 of bolt 526 directs gas to rear 532 of bolt carrier group 504. The force of gas against rear 532 of bolt carrier group 504 initiates the recoil process. That is, once a set volume "X" of pressurized gas is present in bolt 526, non-lethal projectile 320 is shot forward and bolt carrier group 504 is pushed back. Gas propels non-lethal projectile 320 out of barrel 530 and rear moving gas pushes bolt carrier group 504 backwards creating recoil.

As bolt carrier group 504 travels rearwards, it pushes against primary hammer 510, releasing pressure on secondary hammer 514 and poppet valve 506, and starting reset of the trigger group components.

As bolt carrier group 504 reaches the rear, primary hammer 510 is fully pressed down and reset, ready to fire once bolt carrier group 504 returns to forward. The manner in which bolt carrier group 504 moves forward is well known and conventional. That is, well-known recoil buffer 764 pushes bolt carrier group 504 by a well-known spring (not shown) back to start position (shown in FIG. 5).

FIGS. 6A-6G illustrate bolt carrier 526 (which is part of bolt carrier group 504). Bolt carrier 526 generally includes gas inlet 524, rail ends 542, surface 545, nozzle 547, front bore 548, bottom rail 551, top rail 553, and side rails 555.

FIGS. 7A-7G and 8 illustrate magazine 108. Magazine 108 generally includes housing 110, gas seal 552, top 562, opening 564 feeder 566, rear side 572, rear opening 574, handle 598, latch member 600, shank 601, door 602, hook 603, safety closure 605 and end 607. Housing 110 has a form-factor commensurate with a magazine well 554 of non-lethal gas-operated gun 100. In other words, housing 110 is shaped or configured and is adapted to be used with and fit non-lethal gas-operated gun 100.

Magazine 108 looks, feels, and generally provides the same experience as a conventional magazine of a conventional rifle such as the M4. To use magazine 108, a user may insert magazine 108 into magazine well 554 and use non-lethal gas-operated gun 100 as if using a conventional rifle such as the M4. Magazine 108 includes a pre-pack 556 (detailed below) that supplies rounds to non-lethal gas-operated gun 100 through the action of the reciprocal bolt carrier group 504 as detailed above. Magazine 108 also includes a gas regulator system 512 (detailed below) for supply of gas (generally $CO_2$) to non-lethal gas-operated gun 100.

Housing 110 includes a top side 562 that interfaces with upper receiver 102 of non-lethal gas-operated gun 100 and includes a front opening 564 that receives feeder 566 of a pre-pack 556. Housing 110 defines recess 112 adapted to receive end 607 safety closure 605. Housing 110 also defines recess 113 adapted to receive safety closure 605. Top side 562 further includes gas seal 552, and has a top, rear lateral opening 568 for receiving a strike (or actuation or switch) member 570 of a poppet valve 506.

Rear side 572 of magazine 108 includes a rear opening 574 for optionally enabling access to an adjuster mechanism 716 for gas regulator system 512. The magazine further includes an enclosure assembly that includes latch mechanism 600 and door 602 to enable access into an interior of housing 110 of magazine 108 to insert and remove pre-pack 556.

FIGS. 9A-9D are progressive illustrations of a method of insertion (and removal, if reversed) of a pre-pack 556 into the magazine housing 110 of magazine 108. As shown, pre-pack 556 can be inserted and removed from housing 110 through door 602.

Once a pre-pack 556 is used and emptied out of its non-lethal projectiles 320, it may be removed and replaced with a new pre-pack 556. A new pre-pack 556 may be inserted into magazine housing 110 by opening door 602 and inserting a new pre-pack 556 and finally closing door 602. Door 602 is pivotally connected to housing 110 on one end with the other end being selectively secured by latch member 600.

FIGS. 10A-10K illustrate pre-pack 556. Pre-pack 556 generally includes gas canister 206, a plurality of projectiles 320, casing 640, projectile actuator assembly 642, spring 662, and tab 675. As detailed above, magazine 108 accommodates and houses pre-pack 556. Casing 640 may also include feeder 566. Feeder 566 defines ejector opening 322, loader-opening 324 and restrictor opening 328. Loader-opening 324 is adapted to allow passage of bottom rail 551 through its forward motion to strip a projectile 320 through ejector opening 322. Restrictor opening 328 is configured to block passage of non-lethal projectiles 320 along the longitudinal axis of pre-pack 556 through feeder 566. Note that spring 662 provides a constant load acting on non-lethal projectiles 320 forcing them to move upward towards restrictor opening 328.

Casing 640 may comprise two mirrored pieces that may be connected together by a living hinge, solvent-bonded together, mechanically clipped together, ultrasonic welded together, or other known methods of connections. Pre-pack 556 also includes canister 206 that may be secured to pre-pack 556 in a variety of ways, including, but not limited to, adhesives that fix canister 206 to casing 640.

Figure 11C:
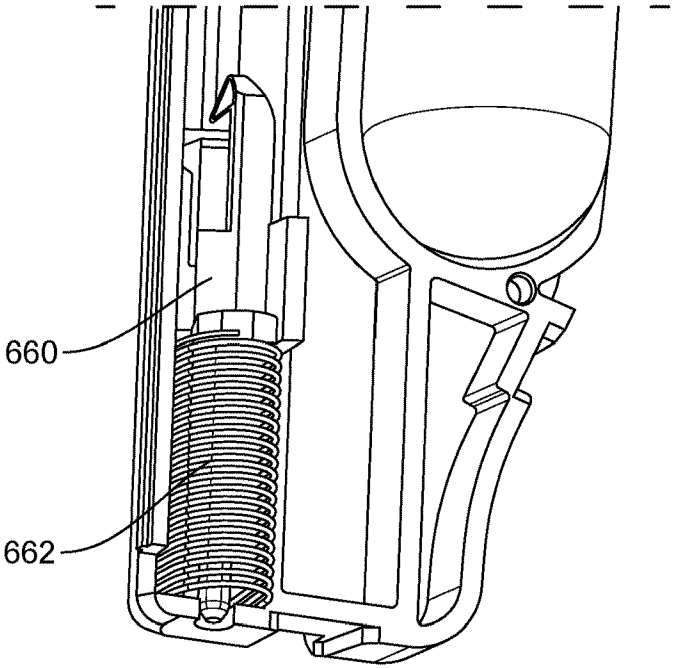
FIG. 11C is an enlarged view of a portion of FIG. 11A with a tab removed.
Figure 11B:
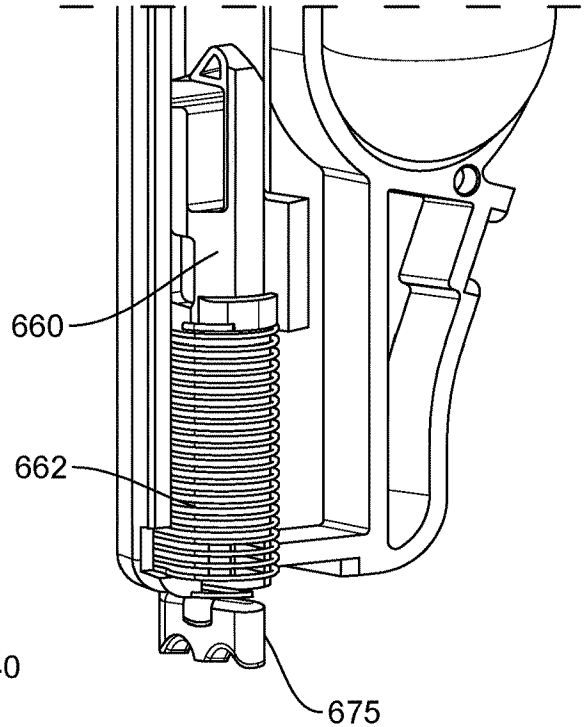
FIG. 11B is an enlarged view of a portion of FIG. 11A.
Figure 11A:
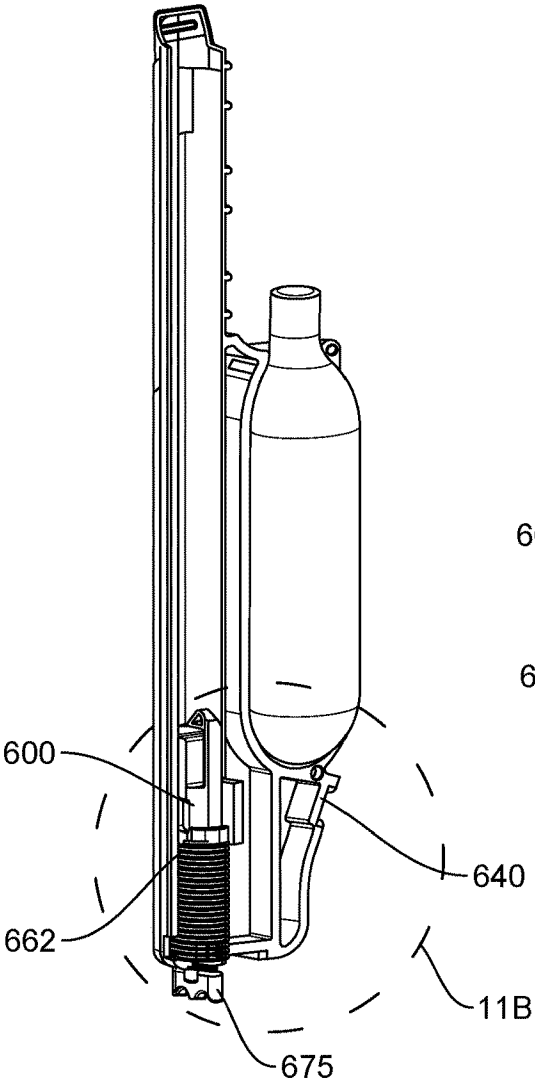
FIG. 11A is a side perspective view of the FIG. 10A pre-pack with a portion of a cover removed.

Referring to FIGS. 11A-11C, the use of tab 675 is illustrated. Tab 675 is coupled to actuator assembly 642 and sits outside of casing 640. While in place, tab 675 holds spring 662 compressed and blocks actuator assembly 642 from applying force to the plurality of projectiles 320. Tab 675 is configured such that a user can remove tab 675, such as by twisting tab 675, before inserting pre-pack 556 into a magazine 108 (as shown in FIG. 11C). Once tab 675 is removed (as shown in FIG. 11C), follower 660 is pushed up due to the force of spring 662, which moves non-lethal projectiles 320 towards feeder 566, with non-lethal projectiles remaining at the feeder 566 (and not falling or popping out) due to restrictor opening 328. After which, bottom non-lethal projectiles 320 are moved up by the force of biasing mechanism 662 as top non-lethal projectiles 320 are fed into the gun chamber.

Referring to FIGS. 12A-12D, cross-section of pre-pack 556 are shown illustrating progressive firing of projectiles 320. As shown in FIGS. 12A-12D, casing 640 defines a storage portion 563 configured to hold projectiles 320 in a double stack patter. A width W1 of storage portion 563 is greater than 1.5 times a diameter of a projectile 320 and less than 2 times the diameter of a projectile 320. Casing 640 also defines transition portion 567 positioned between feeder 566 and storage portion 563. Transition portion 567 tapers the internal opening down from W1 to feeder 566 to help facilitate transitioning the double stack pattern to a single stack pattern at feeder 566.

Figures 12A, 12B, 12C, 12D:
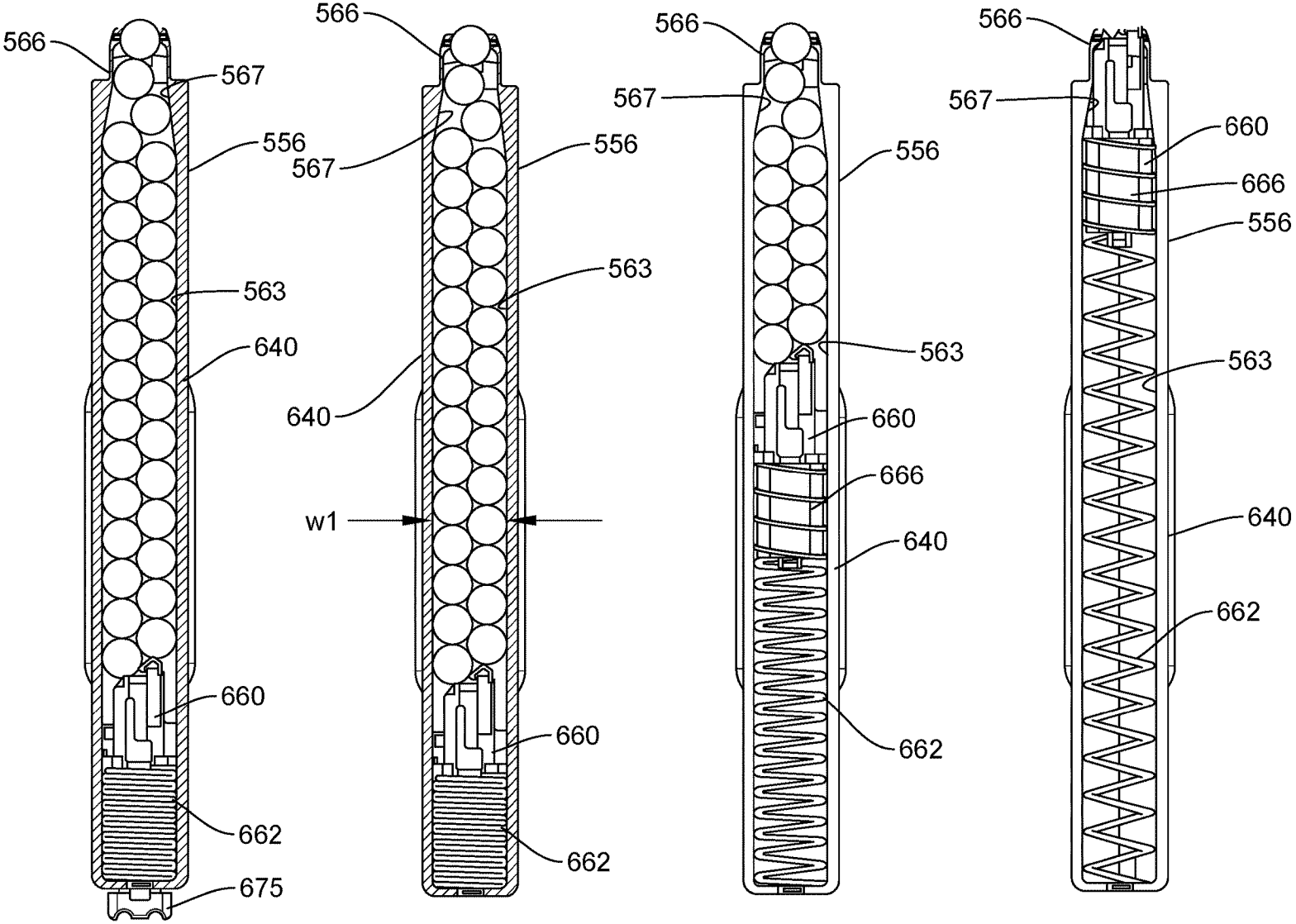
FIG. 12A is a cross-sectional view of the FIG. 10A pre-pack taken along line 12A in FIG. 10H.
FIG. 12B is a cross-sectional view corresponding to FIG. 12A with a tab removed.
FIG. 12C is a cross-sectional view corresponding to FIG. 12B with approximately half the rounds depleted.
FIG. 12D is a cross-sectional view corresponding to FIG. 12B with all of the rounds depleted.
Figure 13C:
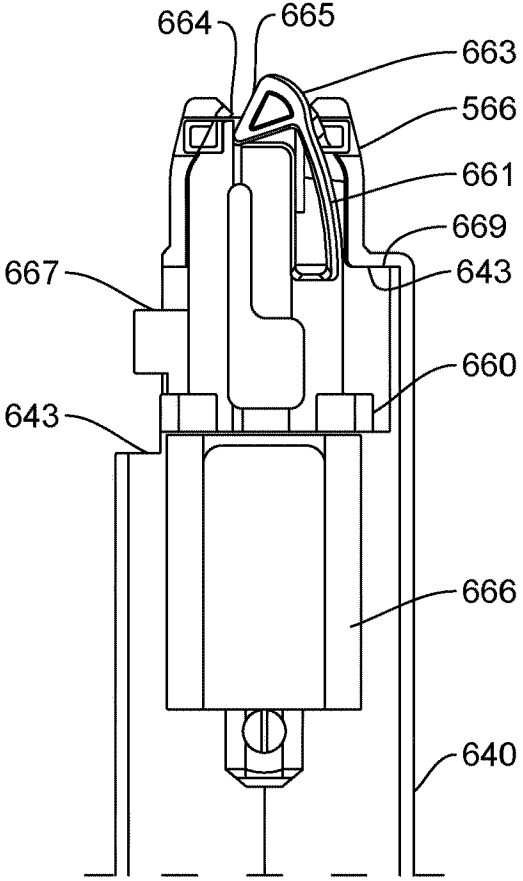
FIG. 13C is a cross-section view of the pre-pack shown in FIG. 13B with the follower advanced to the top.
Figure 13B:
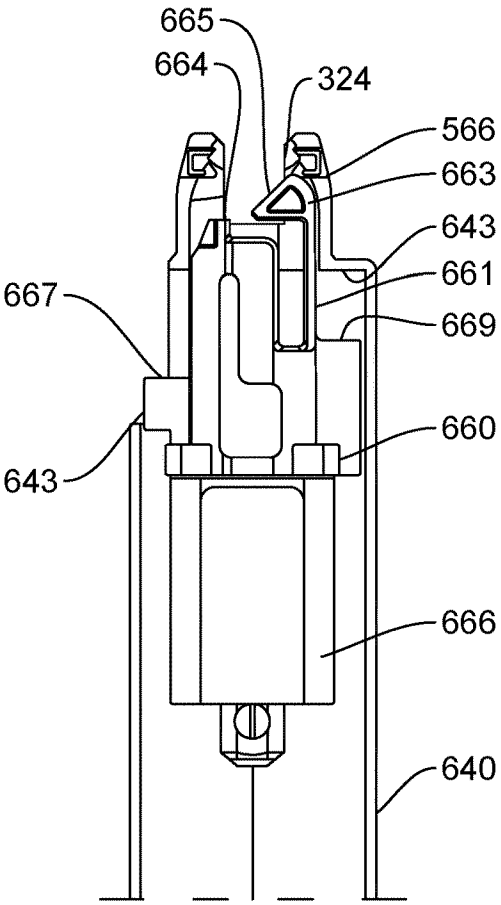
FIG. 13B is a cross-section view of the pre-pack shown in FIG. 13A with the follower advanced near the top.
Figure 13A:
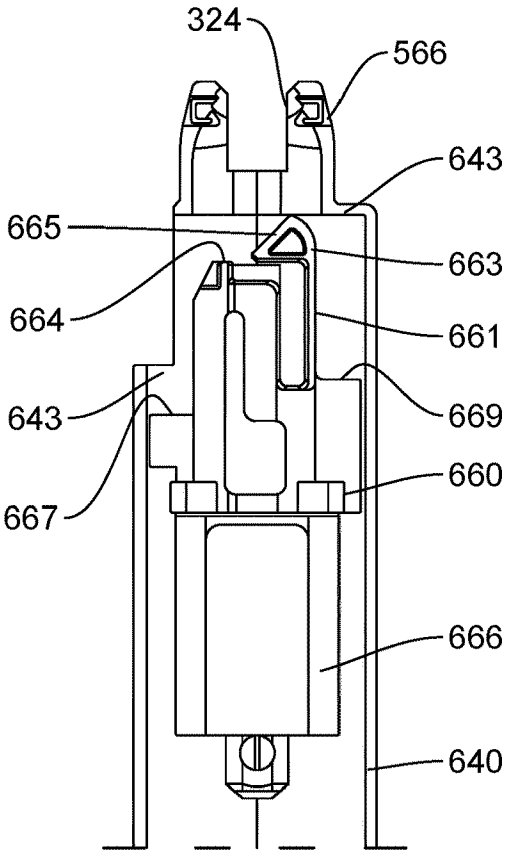
FIG. 13A is a cross-sectional view of the top of the pre-pack without projectiles.

Referring to FIGS. 13A-13C, a cross section of the top of pre-pack 556 is illustrated without projectiles for clarity. As shown in FIGS. 13A-13C, follower 660 comprises body 666 around which spring 662 is wrapped. Follower 660 also comprises arm 661, head 663, surface 664, surface 665, actuator 667, and shoulder 669. Casing 640 further comprise stop 641 and further defines opening 643. Arm 661 is bendable such that head 663 can deflect inward when it reaches feeder 566 such that head 663 is positioned in opening 324. Applicant has determined that moving head 663 in this way improves the reliability of feeding the last few projectiles in a stack. Head 663 defines surface 665 which is inclined relative to surface 664 such that head 663 abuts the bottom two projectiles when the projectiles are double stacked. As shown in FIGS. 12A-12C, head 663 engages two different projectiles in storage portion 563, with surface 664 also contacting one of the projectiles, but not the other.

Stop 643 and shoulder 669 are configured as a hard stop that blocks follower 660 from advancing any further than the position shown in FIG. 13C. Opening 643 is configured so that actuator 667 can engage a bolt catch actuator when the last projectile 320 is removed and follower 660 is in the position shown in FIG. 13C.

Figure 14B:
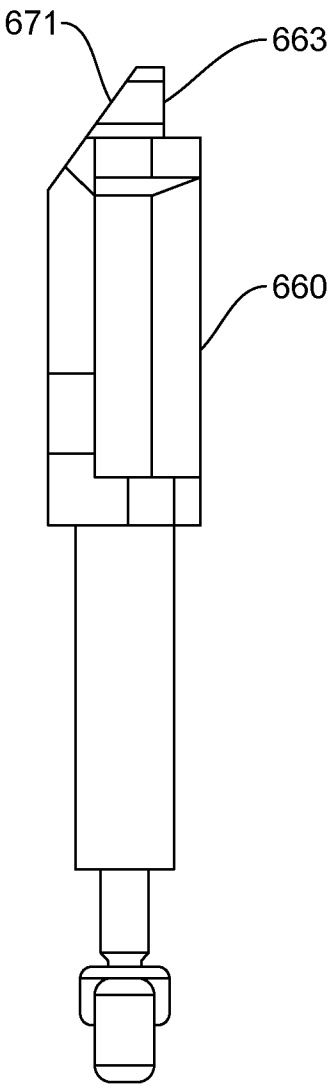
FIG. 14B is a side view of the FIG. 14A follower.
Figure 14A:
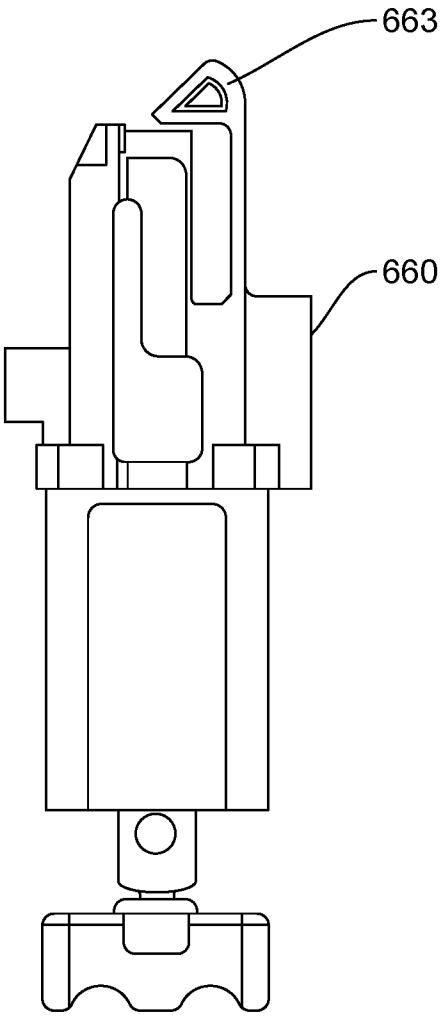
FIG. 14A is a front view of a follower.

Referring to FIGS. 14A and 14B, follower 660 is illustrated. As shown in FIG. 14B, follower 660 and head 663 define ramp 671. In the event of an inadvertent release of the bolt catch, bolt 526 could engage ramp 671 and push follower 660 down against spring 662. This may help prevent damage to bolt 526 when head 663 is exposed in opening 324 after the last projectile is expended.

Figure 15:
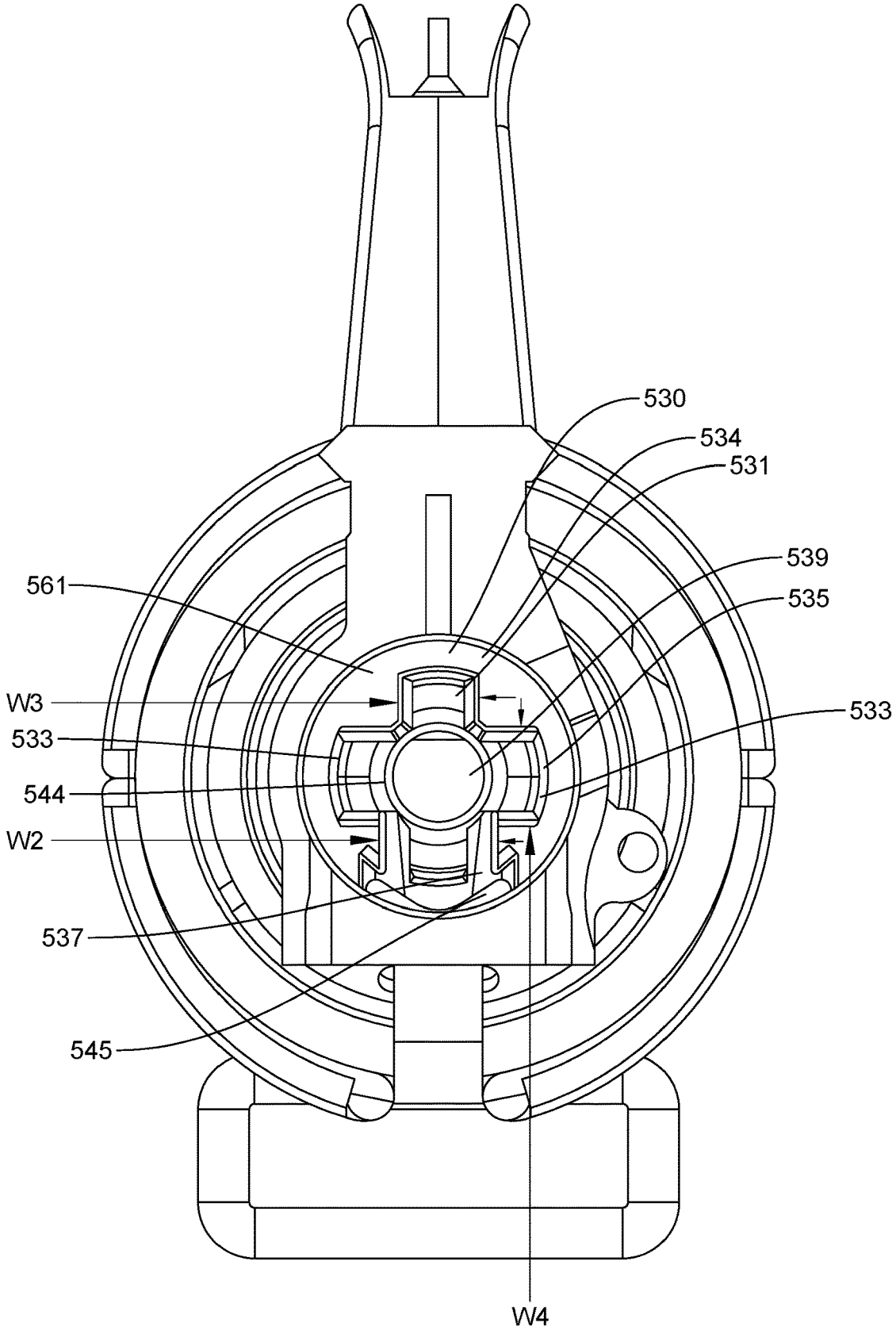
FIG. 15 is a view of the barrel assembly block looking down the barrel.

Referring to FIG. 15, the barrel assembly block is illustrated looking down barrel 530. The barrel assembly block includes hood 534, hop-up 544, ramp 545 and front face 561. Hood 534 is adapted to help guild rounds into hop-up 544. Hood 534 defines cruciform recess 535 which includes top recess 531, side recesses 533, bottom recess 537 and center recess 539. Bottom recess 537 has a width W2. Top recess has a width W3. Side recess 533 have a width W4. Width W2 is larger than the diameter of projectile 320. In one embodiment, width W2 is approximately 110% the diameter of projectile 320. Width W3 is smaller than the diameter of projectile 320. In one embodiment, width W3 is approximately 75% the diameter of projectile 320. Width W4 is smaller than the diameter of projectile 320. In the illustrated embodiment, width W4 is approximately 55% the diameter of projectile 320. In the illustrated embodiment, projectile 320 is an 8 mm round with an 8 mm diameter (0.315").

Figure 16B:
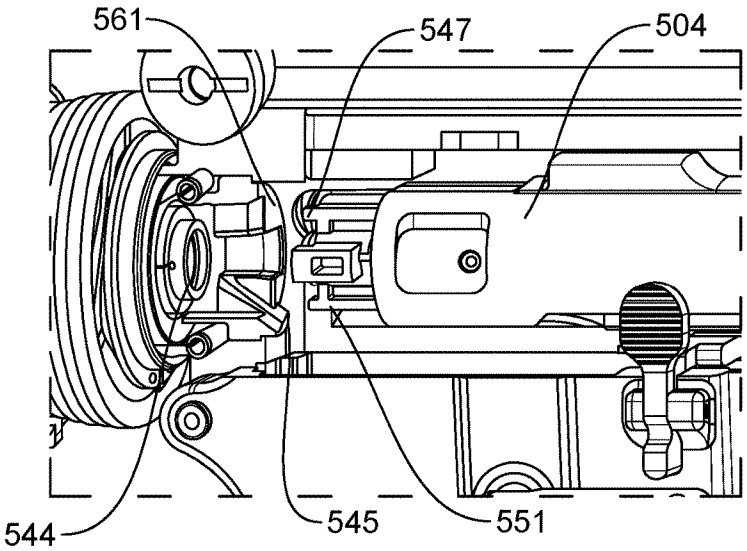
FIG. 16B is a perspective view of the barrel assembly block and the bolt carrier shown in FIG. 16A with a portion of the hood removed.
Figure 16D:
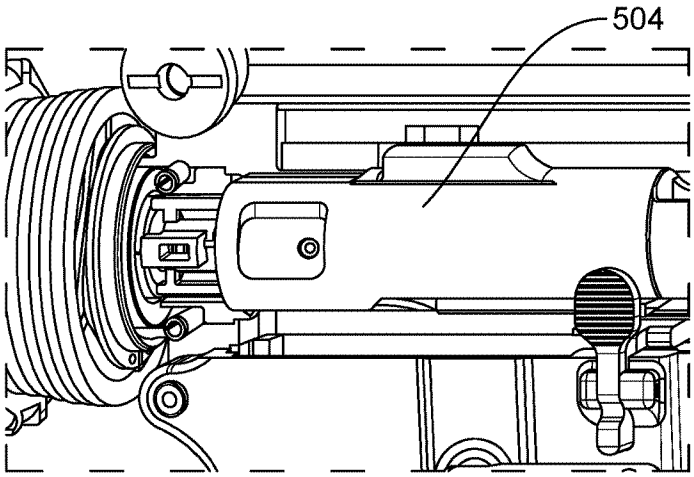
FIG. 16D is a perspective view of the barrel assembly block and the bolt carrier shown in FIG. 16C with a portion of the hood removed.
Figure 16A:
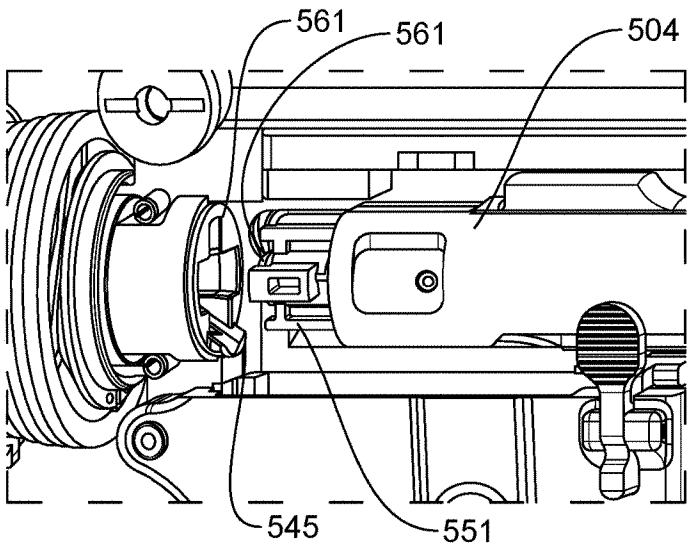
FIG. 16A is a perspective view of the barrel assembly block and the bolt carrier.
Figure 16C:
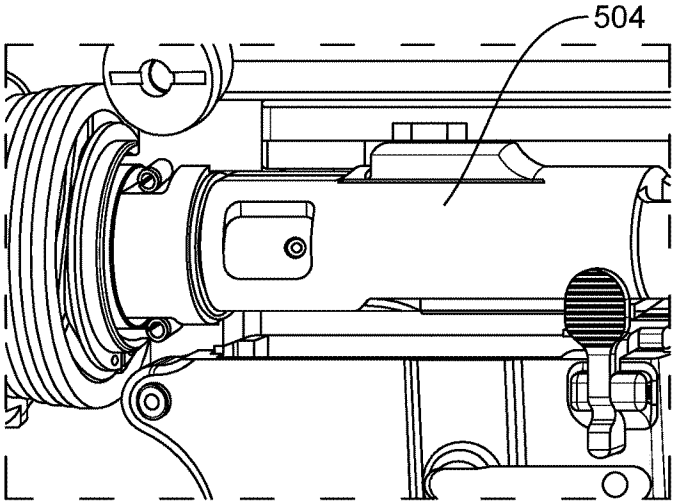
FIG. 16C is a perspective view of the barrel assembly block and the bolt carrier with the bolt carrier positioned in a firing position.

Referring now to FIGS. 16A-16D, the interface between hood 534 and bolt carrier group 504 is shown. As best shown in FIGS. 16A and 16B, ramp 545 extends beyond front face 561 of hood 534.

Figure 17C:
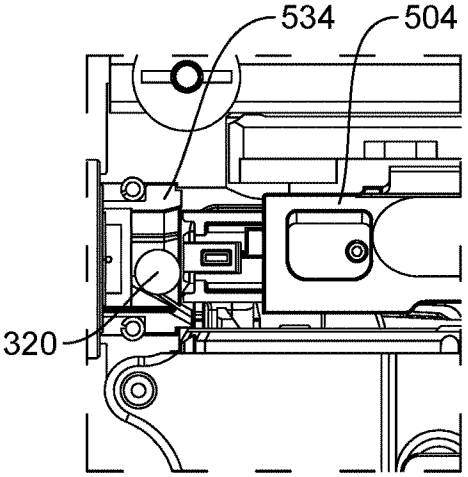
FIG. 17C is a side cross-sectional view of the barrel assembly block and the bolt carrier with the projectile fully within the hood but not yet centered.
Figure 17B:
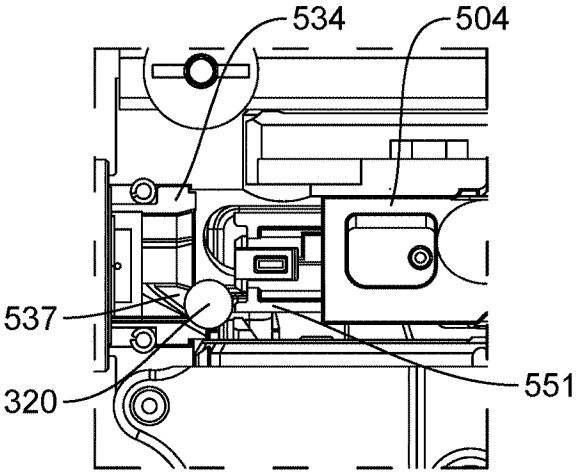
FIG. 17B is a side cross-sectional view of the barrel assembly block and the bolt carrier with the projectile beginning to enter the hood.
Figure 17A:
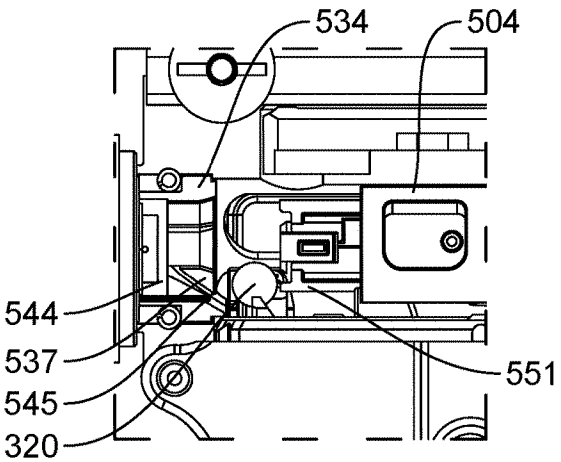
FIG. 17A is a side cross-sectional view of the barrel assembly block and the bolt carrier with the bolt carrier beginning to strip a projectile from the magazine.
Figure 17E:
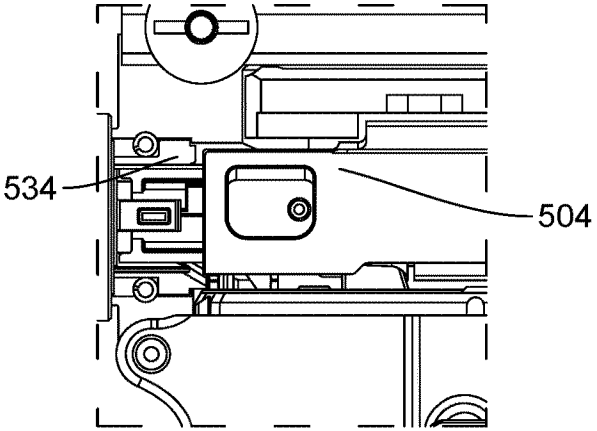
FIG. 17E is a side cross-sectional view of the barrel assembly block and the bolt carrier with the bolt carrier positioned in a firing position.
Figure 17D:
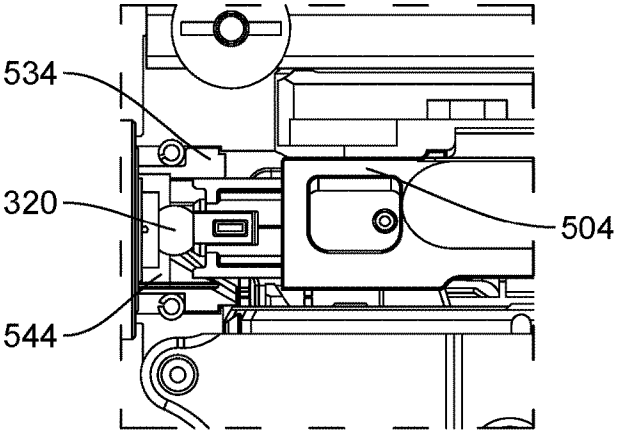
FIG. 17D is a side cross-sectional view of the barrel assembly block and the bolt carrier with the projectile centered in the hood.

Referring now to FIGS. 17A-17E, a progressive loading sequence is illustrated. In FIG. 17A, round 320 is positioned within feeder 566 with bottom rail 551 on bolt carrier 504 in contact with projectile 320. In FIG. 17B, bottom rail 551 has begun pushing projectile 320 out on feeder 556 onto ramp 545. A portion of projectile is positioned within bottom recess 537. In FIG. 17C, projectile 320 is pushed up ramp 545 by bottom rail 551. In FIG. 17D, projectile 320 is positioned in center recess 539 abutting hop-up 544 and surface 545 on bolt 526. In FIG. 17E, projectile (not shown) is positioned in hop-up 544 with nozzle 547 sealing against hop-up 544.

Figure 18A:
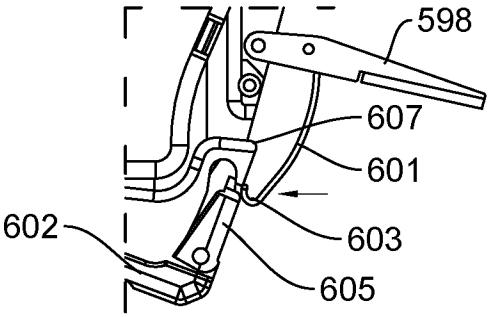
FIG. 18A is a side view of the magazine latching mechanism in an unlatched state.
Figure 18B:
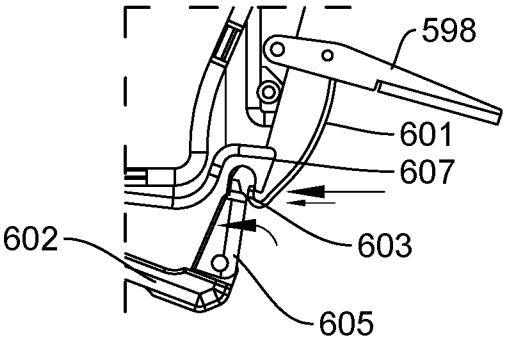
FIG. 18B is a side view of the magazine latching mechanism in an initial latching state.
Figure 18C:
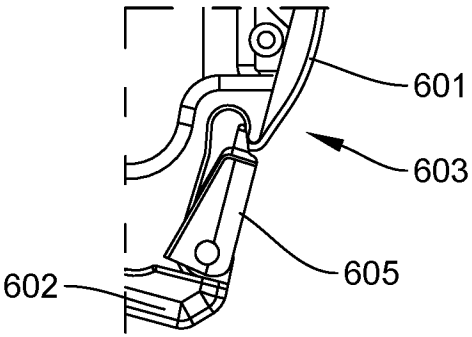
FIG. 18C is a side view of the magazine latching mechanism in an intermediate latched state.
Figure 18D:
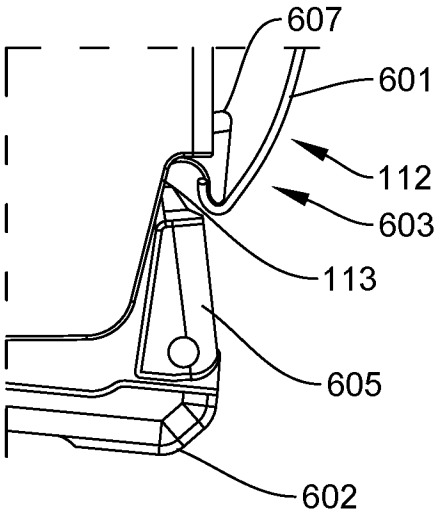
FIG. 18D is a side view of the magazine latching mechanism in an intermediate latched state.
Figure 18E:
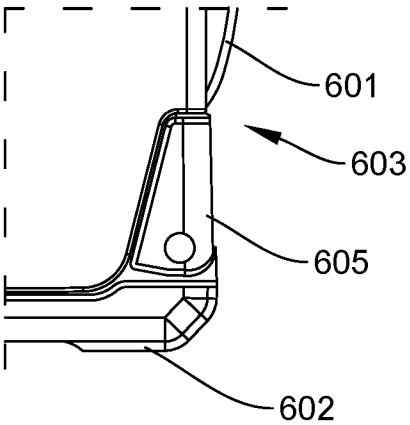
FIG. 18E is a side view of the magazine latching mechanism in a latched state.

Referring now to FIGS. 18A-18E, the operation so latch member 600 is illustrated. In FIG. 18A, latch member 600 is not engaged. In FIG. 18B, hook 603 is partially engaged with catch 604. In FIG. 18C, hook 603 is engaged with catch 604 and safety member 605 is also engaged with hook 603. In FIG. 18D, door 602 is partially closed, with end 607 entering recess 112. In FIG. 18 E, door 602 is completely closed, with end 607 in recess 112 and safety catch filling recess 113. Recess 113 blocks movement of safety catch 605 as long as door 602 is held closed, and safety catch 605 retains hook 603 in engagement with catch 604 in the illustrated position, helping to prevent inadvertent opening of door 602 while latch member 600 is closed. While not illustrated, safety member 605 may optionally be biased toward catch 604.

Figure 19A:
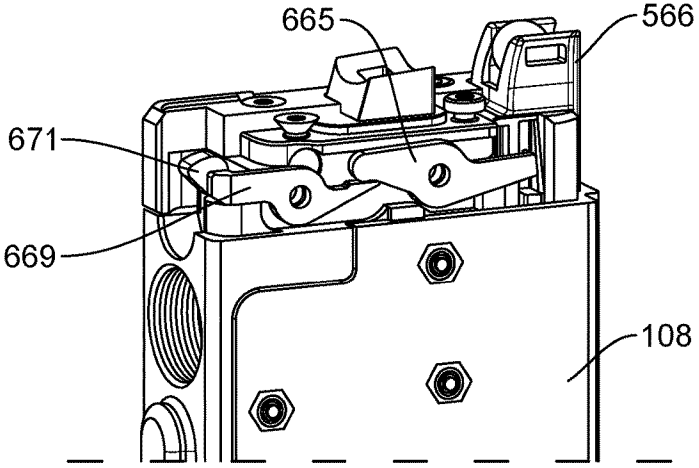
FIG. 19A is a perspective view of a magazine bolt catch in a non-engaged position.
Figure 19B:
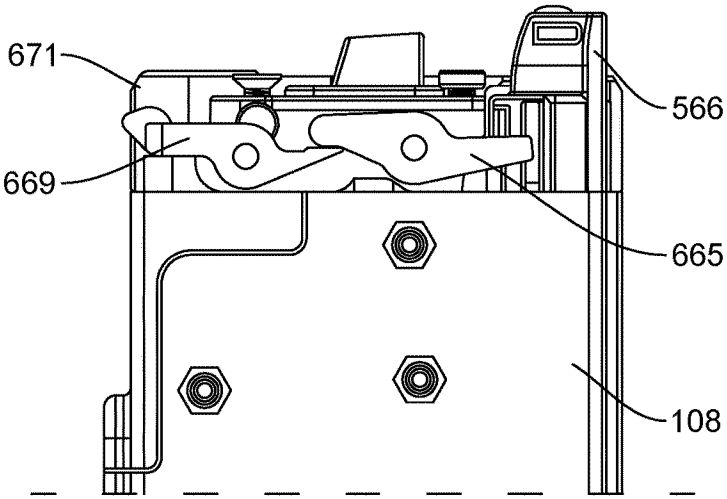
FIG. 19B is a side view of the FIG. 19A magazine bolt catch.
Figure 19C:
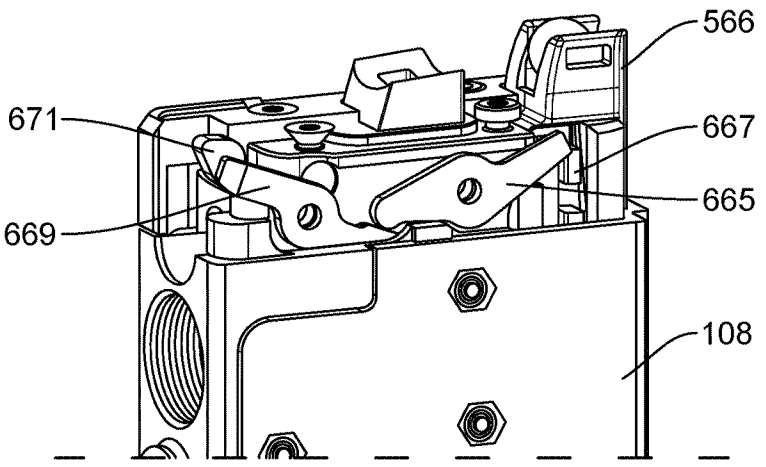
FIG. 19C is a perspective view of the FIG. 19A magazine bolt catch in an engaged position.
Figure 19D:
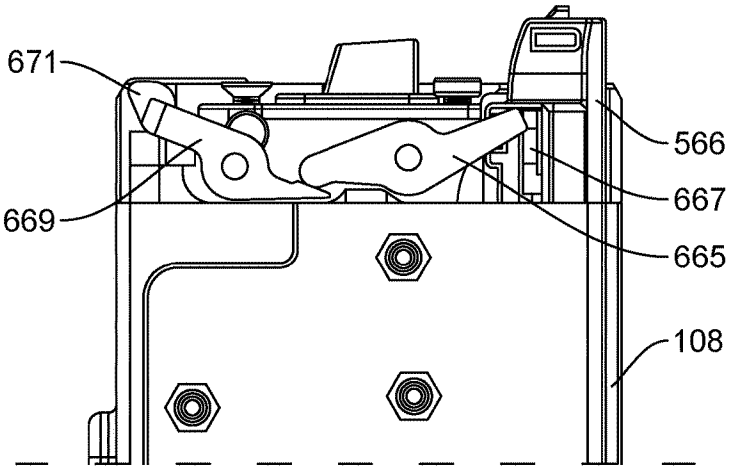
FIG. 19D is a side view of the FIG. 19C configuration.

Referring not to FIGS. 19A-19D, the operation of bolt catch lever 671 is illustrated. As shown in FIGS. 19A-19D, magazine also includes transfer levers 665 and 669 and blot catch lever 671. FIGS. 19A and 19B illustrate the condition when magazine 108 contains projectiles 320 in which bolt catch lever 671 is retracted in a position where it does not engage the bolt catch. In FIGS. 19C and 19D, magazine 108 is empty of projectiles 320 and actuator 667 engages and rotates transfer lever 665, which in turn rotates transfer lever 669, which engages bolt catch lever 671 and lifts it into position to engage the bolt catch, as known in the art.

Latch member 600 also provides a fail-safe feature in the event that canister 206 is accidentally released when still containing pressurized gas, which can cause it to "propel" towards the bottom of magazine 108; with this fail-safe feature, latch 600 catches door 602 and allows gas to expel without the entire pre-pack 556 and/or canister 206 ejecting out of bottom of magazine 108.

Although the claimed invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments have been described, numerous variations and alternative embodiments will occur to those skilled in the art. For example, pre-pack 556 may comprise a single piece rather than two pieces. As another example, the path of the non-lethal projectiles within casings 640 could be purely linear (as shown) or cured in geometries similar to a "J" or a "U" shape to maximize the total number of non-lethal projectiles that could be housed in the allowed space. As yet another example, the two pieces of casing 640 may also be assembled so that the pieces are separated with ease (e.g., using well known detachable connection mechanisms) so that canister 206 or even their respective internally housed projectile actuator modules may be replaced without damaging the respective pre-packs 556. Such variations and alternate embodiments are contemplated, and can be made without departing from the spirit and scope of the claimed invention.

It should further be noted that throughout the entire disclosure, the labels such as left, right, front, back, top, inside, outside, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction, orientation, or position. Instead, they are used to reflect relative locations/positions and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

While the present disclosure has been illustrated and described in detail in the drawings and foregoing description, the same is to be considered as illustrative and not restrictive in character, it being understood that a preferred embodiment has been shown and described and that all changes, equivalents, and modifications that come within the spirit of the claimed invention defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Merriam-Webster dictionary.

We claim:

1. An air gun that fires spherical projectiles having a diameter, the air gun comprising:

a barrel having a barrel block, the barrel block comprising a projectile hop-up, an external face and a cruciform shaped recess extending inwardly from the face and, the cruciform recess including a center recess, a top recess, two side recesses and a bottom recess, wherein the projectile hop-up is positioned within the center recess, wherein a width of the bottom recess is larger than the diameter and wherein a width of the top recess is smaller than the diameter; and a ramp positioned at the bottom of the bottom recess that extends from the center recess through the bottom recess and away from the face.

2. The air gun of claim 1, wherein a width of the two side recesses are smaller than the diameter.

3. The air gun of claim 2, wherein the width of the two side recesses are larger than the width of the top recess.

4. The air gun of claim 1, further comprising: a bolt carrier having a front end, the front end comprising a bottom rail, and a nozzle configured to seal within the center recess when the bolt carrier is in a firing position, wherein the bottom rail is configured to strip a projectile from a magazine and push the projectile up the ramp into the center recess and wherein the front end defines a recess extending between the bottom rail and the nozzle.

5. The air gun of claim 4, wherein the bolt carrier defines a plane extending along the front end and where the nozzle and an end of the bottom rail are both on the plane.

6. The air gun of claim 4, wherein the ramp defines a recess configured to receive the bottom rail when the bolt carrier is in the firing position.

7. The air gun of claim 4, wherein the nozzle defines a flat surface configured to seal against the projectile hop-up to create a gas-tight chamber between the nozzle and the projectile hop-up.

8. The air gun of claim 4, wherein the front end further comprises a top rail and two side rails and wherein the recess extended around the nozzle between the top rail and the nozzle, and each of the two side rails and the nozzle.

9. The air gun of claim 8, wherein the center recess is configured to receive the top rail, the bottom recess is configured to receive the bottom rail and the two side recesses are configured to receive the two side rails when the bolt carrier is in the firing position.

10. The air gun of claim 4, wherein the bottom rail is configured to contact a projectile positioned at a feeder opening and pushes the projectile onto the ramp as the bolt carrier moves forward.

11. The air gun of claim 10, wherein as the bolt carrier continues to move forward, the bottom rail pushes the projectile up the ramp and into the center recess.

12. The air gun of claim 10, wherein the bottom rail passes through a loader opening in the magazine as the bolt carrier moves from the retracted position toward the firing position.

13. The air gun of claim 1, wherein the cruciform shaped recess defines a recess depth that extends between the projectile hop-up and the external face, wherein the recess depth is greater than the diameter of the spherical projectiles.

14. The air gun of claim 1, wherein the ramp comprises left and right ramp portions separated by a center recess such that an area directly beneath the center of mass of the spherical projectile does not contact the ramp.

* * * * *